US010310410B2

(12) United States Patent
Toba et al.

(10) Patent No.: US 10,310,410 B2
(45) Date of Patent: Jun. 4, 2019

(54) DEVELOPMENT CARTRIDGE, PROCESS CARTRIDGE, AND IMAGE FORMING APPARATUS

(71) Applicant: CANON KABUSHIKI KAISHA, Tokyo (JP)

(72) Inventors: Shinjiro Toba, Yokohama (JP); Tachio Kawai, Tokyo (JP); Hiroyuki Munetsugu, Yokohama (JP); Mitsuhiro Sato, Kawasaki (JP); Yu Fukasawa, Tokyo (JP); Hideki Nagae, Yokohama (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/039,055

(22) Filed: Jul. 18, 2018

(65) Prior Publication Data

US 2019/0025728 A1 Jan. 24, 2019

(30) Foreign Application Priority Data

Jul. 21, 2017 (JP) ..... 2017-142023
Jul. 21, 2017 (JP) ..... 2017-142024

(51) Int. Cl.
*G03G 15/08* (2006.01)

(52) U.S. Cl.
CPC ..... *G03G 15/087* (2013.01); *G03G 15/0808* (2013.01); *G03G 15/0812* (2013.01); *G03G 15/0896* (2013.01); *G03G 2221/163* (2013.01)

(58) Field of Classification Search
CPC ..... G03G 15/0808; G03G 15/0812; G03G 15/087; G03G 15/0896; G03G 2221/163
See application file for complete search history.

(56) References Cited

U.S. PATENT DOCUMENTS 7,561,817 B2 * 7/2009 Sato ..... G03G 15/0822 399/119
8,867,966 B2 * 10/2014 Acosta ..... G03G 15/0886 399/258

FOREIGN PATENT DOCUMENTS

JP 08-286489 A 11/1996
JP 2006-235472 A 9/2006
JP 5750803 B2 7/2015

* cited by examiner

*Primary Examiner* — Hoang X Ngo
(74) *Attorney, Agent, or Firm* — Canon U.S.A., Inc. IP Division

(57) ABSTRACT

An image forming apparatus includes: a cartridge; a developer container, in which the cartridge allows the developer container to be movable between first and second positions; an apparatus main body including an opening through which the cartridge passes when the cartridge is attached and an opening and closing member movable between an open position to open the opening and a close position to close the opening; and a moving member moving to be at different positions between a case where the developer container is attached at the first position and a case where it is attached at the second position, and when the developer container is attached at the first position, the moving member is at a position of preventing movement from the open position to the close position, and when it is attached at the second position, the moving member is at a position of allowing the movement.

8 Claims, 23 Drawing Sheets

DEVELOPMENT CARTRIDGE, PROCESS CARTRIDGE, AND IMAGE FORMING APPARATUS

BACKGROUND OF THE INVENTION

Field of the Invention

The present disclosure relates to an electrophotographic image forming apparatus (hereinafter, referred to as an image forming apparatus), a process cartridge detachably attachable to an image forming apparatus main body of the image forming apparatus, and a toner cartridge.

Description of the Related Art

Some image forming apparatuses have been known to adopt a process cartridge method in which a member that needs to be replaced periodically and toner that needs to be supplied are formed into a cartridge so as to be detachably attachable to the image forming apparatus main body.

With such a cartridge method, maintenance operations for the image forming apparatus are able to be performed by a user himself or herself without relying on a service person, and therefore, operationality is able to be remarkably improved. Thus, the cartridge method is widely used in image forming apparatuses.

For example, it is known that toner is supplied from a toner cartridge to an image forming unit (Japanese Patent No. 5750803). In this manner, a toner cartridge a consumption of which is large is detachably attachable to an image forming apparatus main body, so that a user is able to replace the toner cartridge. In a configuration in which the toner cartridge is detachably attachable to the image forming apparatus main body, in a state where the toner cartridge is not attached or is attached incompletely, tone supply becomes impossible and image formation is difficult to be performed. Thus, a configuration in which a mechanical mechanism and an electric detection unit that are provided in the image forming apparatus main body are used to alert a user to failure of attachment or incomplete attachment of the toner cartridge is known.

On the other hand, a configuration in which a photosensitive drum and a process unit acting on the photosensitive drum are integrated to form a process cartridge, or a development cartridge in which a development unit configured to perform development for the photosensitive drum is unified are known. In a configuration in which a toner cartridge is attached to the process cartridge or the development cartridge, it is not configured so that the toner cartridge is attached to an image forming apparatus main body. Thus, a configuration which allows alerting a user to failure of attachment or incomplete attachment of the toner cartridge has been demanded.

SUMMARY OF THE INVENTION

According to a first aspect of the disclosure, an image forming apparatus includes: a cartridge that includes a developer carrier configured to carry developer on a surface thereof and a blade configured to regulate thickness of the developer carried on the surface of the developer carrier; a developer container detachably attachable to the cartridge and containing the developer, in which the developer container is movable, with respect to the cartridge, between a first position and a second position different from the first position in a state where the developer container is attached to the cartridge; an apparatus main body that has an attachment portion to which the cartridge is attached, in which the apparatus main body includes an opening through which the cartridge passes when the cartridge is attached to the attachment portion and an opening and closing member that is configured to be movable between an open position where the opening is opened and a close position where the opening is closed; and a moving member that moves so that in a case where the cartridge in which the developer container is attached at the first position is attached to the attachment portion, the moving member is at a position of preventing movement of the opening and closing member from the open position to the close position, and in a case where the cartridge in which the developer container is attached at the second position is attached to the attachment portion, the moving member is at a position of allowing movement of the opening and closing member from the open position to the close position.

Further features of the present disclosure will become apparent from the following description of exemplary embodiments with reference to the attached drawings.

DESCRIPTION OF THE EMBODIMENTS

An image forming apparatus and a process cartridge used in the image forming apparatus according to the disclosure. The present embodiment will be described by taking the aforementioned process cartridge that is detachably attachable to an image forming apparatus main body as an example. The process cartridge is broadly divided into a drum unit having a photosensitive drum that is an image carrier, and a development unit having a development roller (developer carrier) that carries developer by which an electrostatic latent image of the image carrier is visualized, and the respective units are integrated to form the cartridge. In the following description, longitudinal directions of the drum unit and the development unit are directions almost parallel to a rotational axis L1 of the photosensitive drum and a rotational axis L9 of the development roller. The rotational axis L1 of the photosensitive drum and the rotational axis L9 of the development roller are directions intersecting a conveyance direction of a recording medium. Transverse directions of the drum unit and the development unit are directions almost orthogonal to the rotational axis L1 of the photosensitive drum and the rotational axis L9 of the development roller. In the present embodiment, a direction in which the process cartridge is attached to or detached from the image forming apparatus main body is the transverse direction of the process cartridge. Reference signs in the following description are provided for referencing the drawings, and do not intend to limit a configuration.

Embodiment

(1) Overall Description of Image Forming Apparatus

Figure 2:
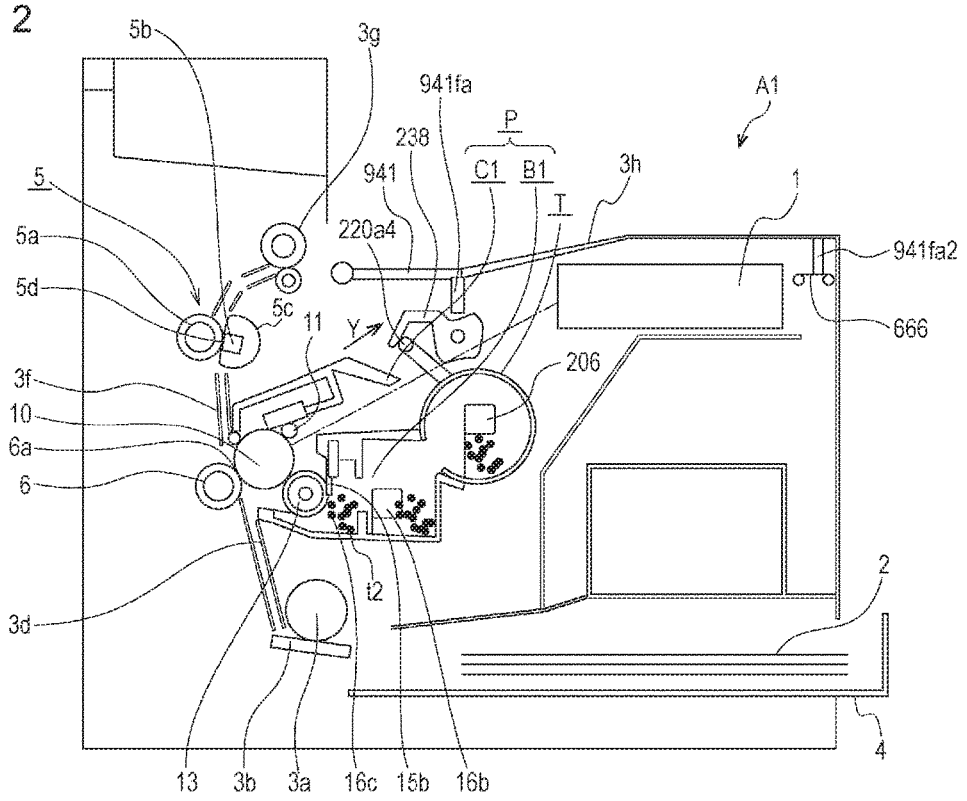
FIG. 2 is a cross-sectional side view of an image forming apparatus according to the embodiment of the disclosure.

First, an overall configuration of an image forming apparatus to which an embodiment of the disclosure is applied will be described with reference to FIG. 2. FIG. 2 is a cross-sectional explanatory side view of the image forming apparatus.

An image forming apparatus main body A1 illustrated in FIG. 2 forms an image with developer (hereinafter, toner) t2 on a recording medium 2 by an electrophotographic image forming process in accordance with image information communicated from an external device such as a personal computer. In the image forming apparatus main body A1, a process cartridge P in which a development unit B1 and a drum unit C1 are integrated is provided so as to be attachable to or detachable from the image forming apparatus main body A1 by a user. Further, a toner cartridge (developer container) T is provided so as to be detachably attachable to the development unit B1 of the process cartridge P. The toner cartridge T contains the toner (developer) t2 supplied to the development unit B1. Examples of the recording medium 2 include a recording sheet of paper, a label sheet of paper, an OHP sheet, cloth, and the like. The development unit B1 has a development roller 13 and the like and the drum unit C1 has a photosensitive drum 10, a charging roller 11, and the like.

The photosensitive drum 10 uniformly charges a surface of the photosensitive drum 10 with use of the charging roller 11 by application of a voltage from the image forming apparatus main body A1. Then, the photosensitive drum 10 that is charged is irradiated with a laser beam L that is emitted from an optical unit 1 and corresponds to image information and an electrostatic latent image corresponding to the image information is formed on the photosensitive drum 10. The electrostatic latent image is developed with the toner t2 by a development unit described below and a developed image is formed on the surface of the photosensitive drum 10.

On the other hand, each recording medium 2 accommodated in a sheet feed tray 4 is separated and fed one by one by being regulated by a sheet feeding roller 3*a* and a separation pad 3*b*, which is in a pressure contact with the sheet feeding roller 3*a*, in synchronization with formation of the developed image. Then, a conveyance guide 3*d* conveys the recording medium 2 to a transfer roller 6 serving as a transfer unit. The transfer roller 6 is urged so as to contact the surface of the photosensitive drum 10.

Next, the recording medium 2 passes through a transfer nip portion 6*a* formed by the photosensitive drum 10 and the transfer roller 6. At this time, a voltage having a polarity opposite to that of the developed image is applied to the transfer roller 6, so that the developed image formed on the surface of the photosensitive drum 10 is transferred onto the recording medium 2.

The recording medium 2 onto which the developed image is transferred is regulated by a conveyance guide 3*f* and conveyed to a fixing unit 5. The fixing unit 5 includes a driving roller 5*a* and a fixing roller 5*c* in which a heater 5*b* is built. Heat and pressure are applied to the recording medium 2 when passing through a nip portion 5*d* formed by the driving roller 5*a* and the fixing roller 5*c*, and the developed image transferred onto the recording medium 2 is fixed to the recording medium 2. Thereby, an image is formed on the recording medium 2.

Thereafter, the recording medium 2 is conveyed by a discharge roller pair 3*g* and discharged to a discharge portion 3.

(2) Description of Electrophotographic Image Forming Process

Figure 3:
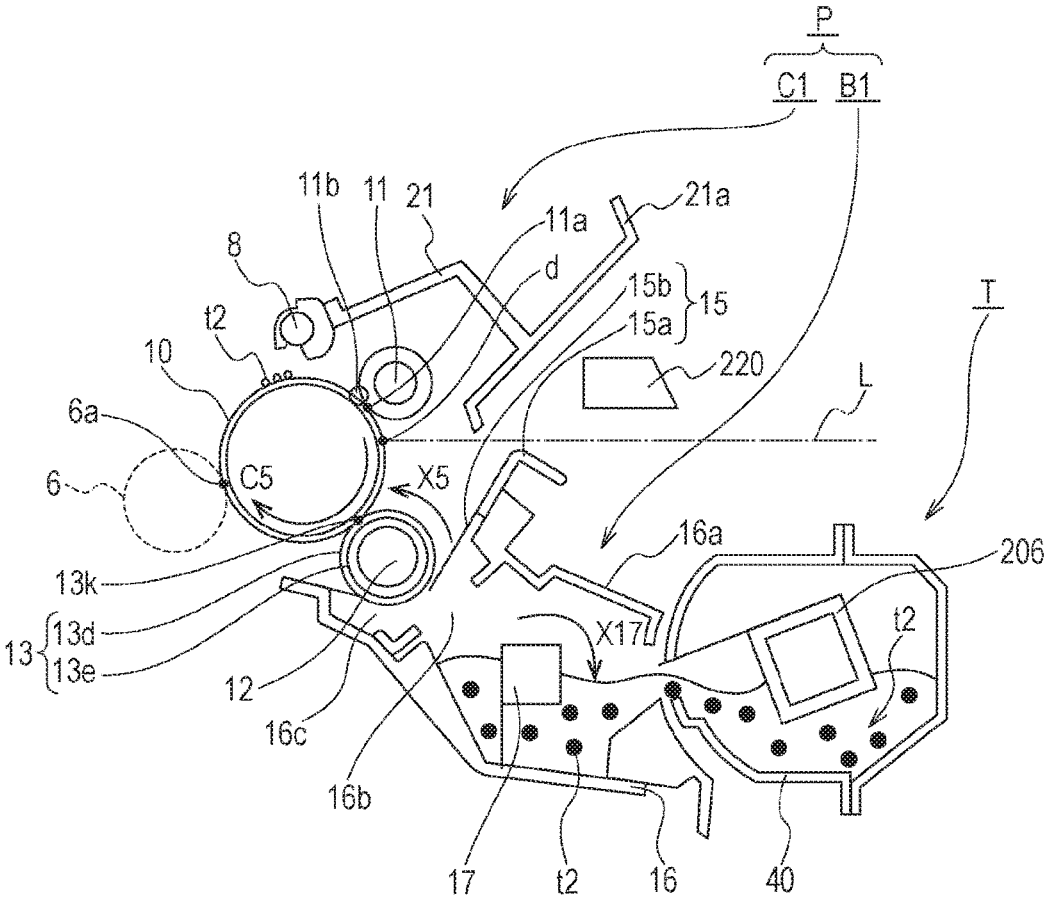
FIG. 3 is a cross-sectional side view of the process cartridge and the toner cartridge according to the embodiment of the disclosure.

Next, the electrophotographic image forming process to which the embodiment of the disclosure is applied will be described with reference to FIG. 3. FIG. 3 is a cross-sectional explanatory view of the process cartridge P and the toner cartridge T. Note that, in the present embodiment, a longitudinal direction of the process cartridge P refers to an axial direction of a rotational axis L10 of the photosensitive drum 10 of the drum unit C1.

As illustrated in FIG. 3, the development unit B1 includes a development frame 16 as a development frame, in which the development roller 13 as the development unit, a development blade 15, and the like are provided. The drum unit C1 includes a drum support frame 21 in which the photosensitive drum 10, the charging roller 11, and the like are provided.

The toner t2 contained in a developer containing portion 16*a* of the development frame 16 is fed from a development frame opening portion 16*b* of the development frame 16 into a development chamber 16*c* when a developer feeding member 17 which is rotatably supported in the development frame 16 rotates in a direction of an arrow X17. The development roller 13 in which a magnet roller 12 is built is provided in the development frame 16. Specifically, the development roller 13 is constituted by an axis portion 13*e* and a rubber portion 13*d*. The axis portion 13*e* is a slender electroconductive cylinder of aluminum or the like, and a center part thereof in the longitudinal direction is covered with the rubber portion 13*d*. Here, the rubber portion 13*d* covers the axis portion 13*e* so that an outer shape thereof is coaxial with the axis portion 13*e*.

The development roller 13 attracts the toner t2 in the development chamber 16*c* to a surface of the development roller 13 by a magnetic force of the magnet roller 12. The development blade 15 is constituted by a support member 15*a* made of a metal plate and an elastic member 15*b* made from urethane rubber, a SUS plate, or the like, and is provided so that the elastic member 15*b* elastically contacts the development roller 13 with constant contact pressure. Rotation of the development roller 13 in a rotation direction X5 regulates an amount of the toner t2 bonded to the surface of the development roller 13, and imparts a triboelectric charge to the toner t2. Thereby, a toner layer is formed on the surface of the development roller 13. When the development roller 13 to which a voltage is applied from the image forming apparatus main body A1 rotates in the rotation direction X5 while contacting the photosensitive drum 10, the toner t2 is supplied to a development region on the photosensitive drum 10.

The charging roller 11 that is rotatably supported by the drum support frame 21 and is urged in a direction of the photosensitive drum 10 is provided in contact with an outer peripheral surface of the photosensitive drum 10. A detailed configuration will be described below. The charging roller 11 uniformly charges the surface of the photosensitive drum 10 by application of a voltage from the image forming apparatus main body A1. As the voltage to be applied to the charging roller 11, a direct current voltage having a value by which a potential difference between the surface of the photosensitive drum 10 and the charging roller 11 is equal to or greater than a discharge start voltage is applied. At this time, the surface of the photosensitive drum 10 is uniformly contact-charged to have a charged potential (dark portion potential) of −700 V. Then, the laser beam L from the optical unit 1 (FIG. 2) forms an electrostatic latent image on the surface of the photosensitive drum 10. After that, the toner t2 is transferred in accordance with the electrostatic latent image on the photosensitive drum 10 to form a visible image of the electrostatic latent image, thereby forming a developed image on the photosensitive drum 10.

(3) Description of Configuration of Development Unit B1

Figure 4A:
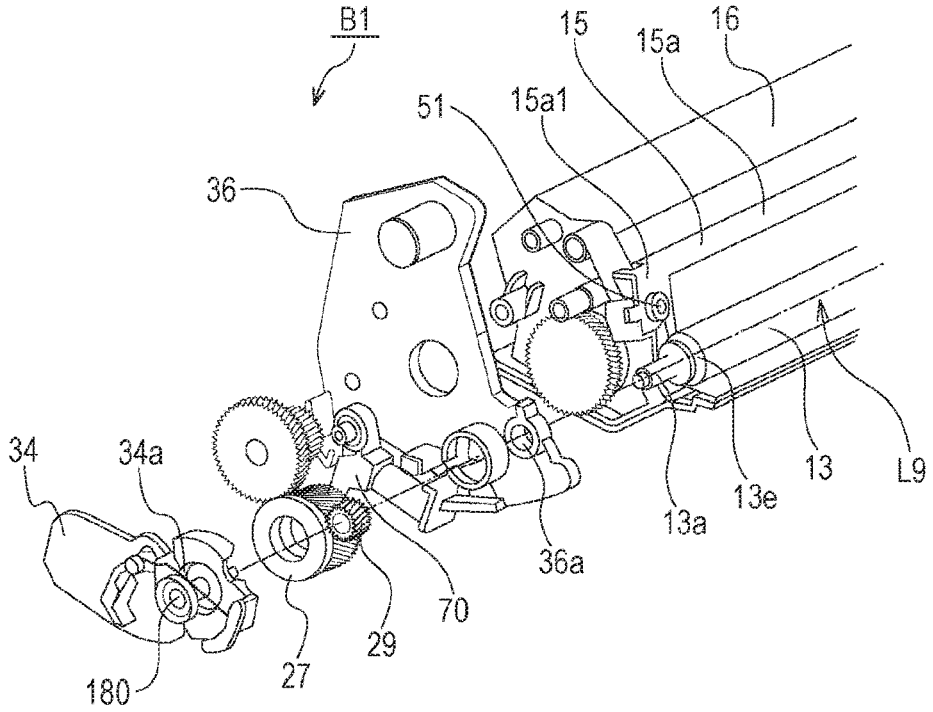
FIGS. 4A and 4B are exploded perspective views of a driving side of a development unit according to the embodiment of the disclosure.
Figure 4B:
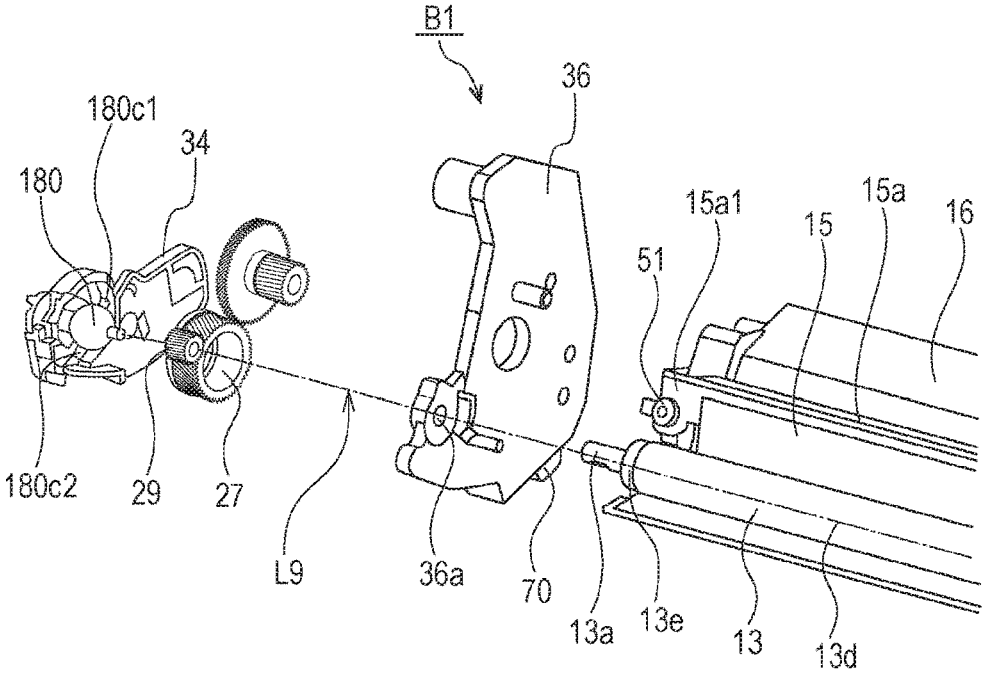
Figure 5A:
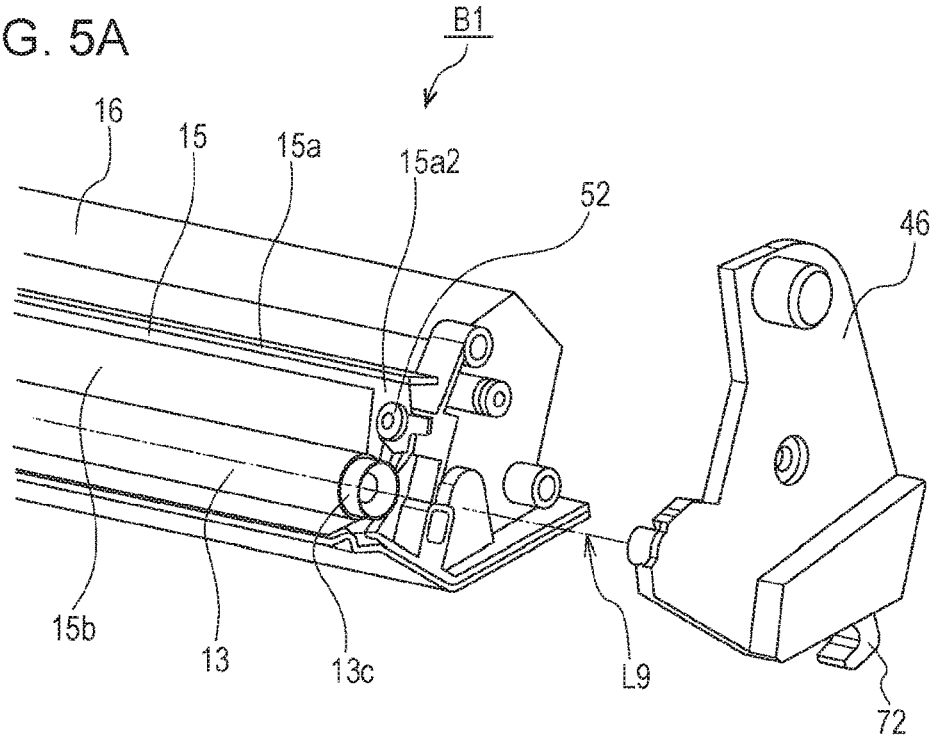
FIGS. 5A and 5B are exploded perspective views of a non-driving side of the development unit according to the embodiment of the disclosure.
Figure 5B:
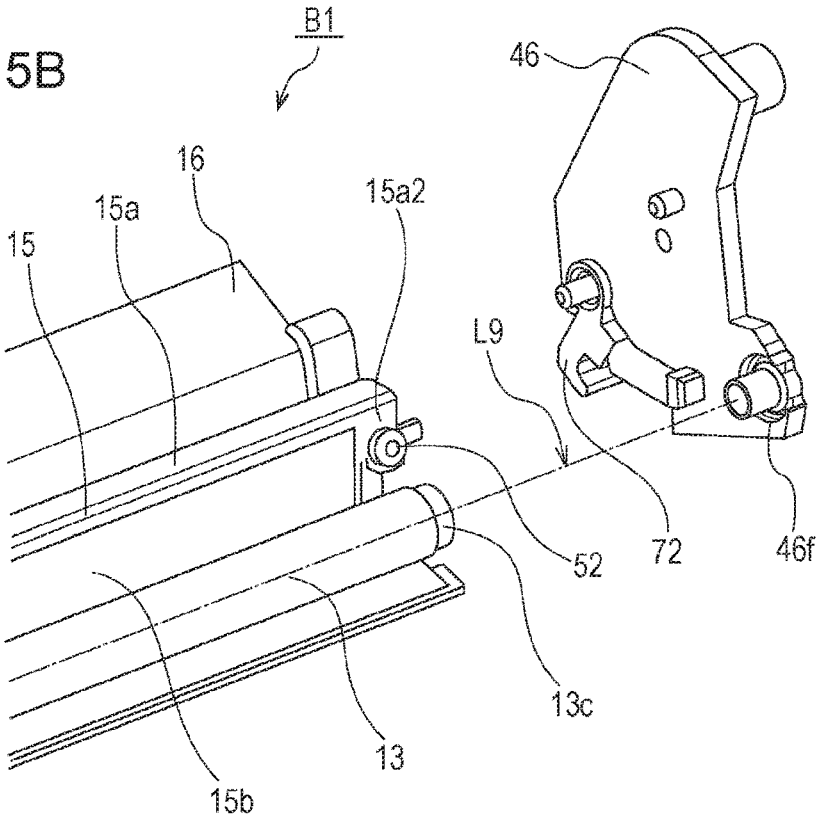

Next, a configuration of the development unit B1 to which the embodiment of the disclosure is applied will be described with reference to FIGS. 4A, 4B, 5A, and 5B. Note that, in the following description, a longitudinal direction of the development unit B1 refers to an axial direction of the rotational axis L9 of the development roller 13 of the development unit B1. Moreover, a side in the longitudinal direction in which a rotary force is transmitted from the image forming apparatus main body A1 to the development unit B1 is referred to as a "driving side". The opposite side in the longitudinal direction is referred to as a "non-driving side". FIGS. 4A and 4B illustrate the development unit B1 with the driving side disassembled, in which FIG. 4A is an explanatory perspective view as seen from the driving side and FIG. 4B is an explanatory perspective view as seen from the non-driving side. FIGS. 5A and 5B illustrate the development unit B1 with the non-driving side disassembled, in which FIG. 5A is an explanatory perspective view as seen from the non-driving side and FIG. 5B is an explanatory perspective view as seen from the driving side.

As illustrated in FIGS. 4A, 4B, 5A, and 5B, the development unit B1 includes the development roller 13, the development blade 15, and the like. In the development blade 15, a driving side end portion 15*a*1 and a non-driving side end portion 15*a*2 in the longitudinal direction of the support member 15*a* are fixed to the development frame 16 by a screw 51 and a screw 52, respectively. A driving side development bearing 36 and a non-driving side development bearing 46 are provided at both longitudinal end portions of the development frame 16. A driving side end portion 13*a* fits into a hole 36*a* of the driving side development bearing 36, and a non-driving side end portion 13*c* fits into a support portion 46*f* of the non-driving side development bearing 46, so that the development roller 13 is rotatably supported. At the driving side end portion 13*a* of the development roller 13, a development roller gear 29 is disposed coaxially with the development roller 13 and outward from the driving side development bearing 36 in the longitudinal direction, so that the development roller 13 and the development roller gear 29 are engaged with each other so as to be rotatable integrally.

The driving side development bearing 36 rotatably supports a driving force input gear 27 at an outer side thereof in the longitudinal direction. The driving force input gear 27 meshes with the development roller gear 29. A coupling member 180 is provided coaxially with the driving force input gear 27. The driving side development bearing 36 includes a driving side contacting/spacing lever 70. The non-driving side development bearing 46 includes a non-driving side contacting/spacing lever 72.

Figure 6A:
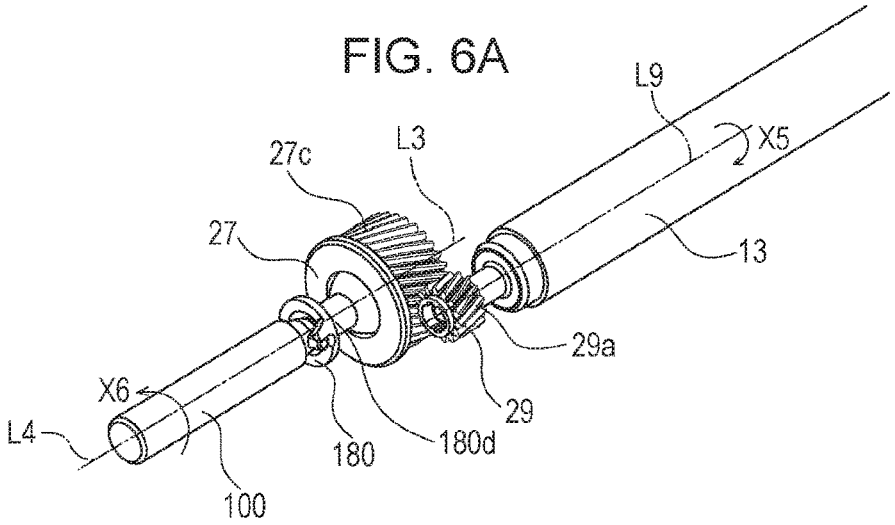
FIGS. 6A to 6E are explanatory views of a coupling member of the process cartridge according to the embodiment of the disclosure.
Figure 6B:
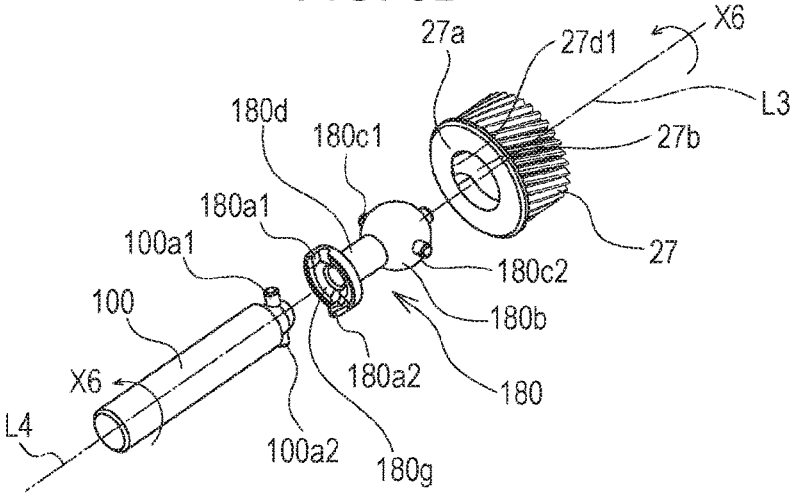
Figure 6C:
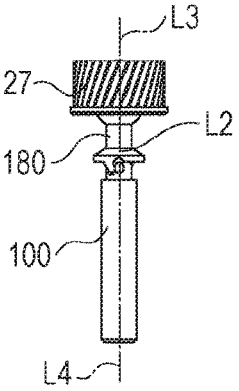
Figure 6D:
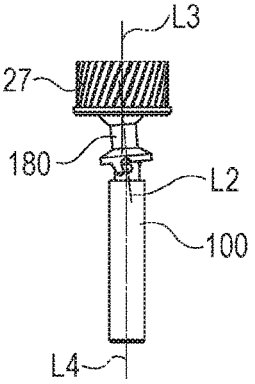
Figure 6E:
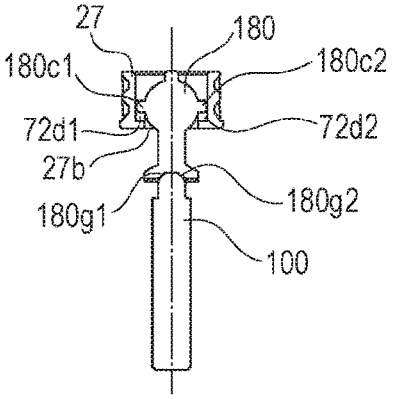

A development side cover 34 is provided at the outermost end portion of the driving side of the development unit B1 so as to cover the driving force input gear 27 and the like from the outer side in the longitudinal direction. The coupling member 180 protrudes to the outside in the longitudinal direction through a hole 34*a* in the development side cover 34. Although described in detail below, the coupling member 180 is configured to be engaged with a main body side driving member 100 (FIGS. 6A to 6E) provided in the image forming apparatus main body A1, so that a rotary force is transmitted. The configuration is such that the rotary force is transmitted to a rotary force transmission-receiving portion 27*d*1 (refer to FIG. 6B) and a rotary force transmission-receiving portion 27*d*2 (not illustrated) of the driving force input gear 27 via rotary force transmitting portions 180*c*1 and 180*c*2 of the coupling member 180. As a result, the configuration is such that the rotary force input to the coupling member 180 is transmitted to the development roller 13 serving as a rotation member via the driving force input gear 27 and the development roller gear 29.

(4) Description of Configuration of Drum Unit C1

Figure 7A:
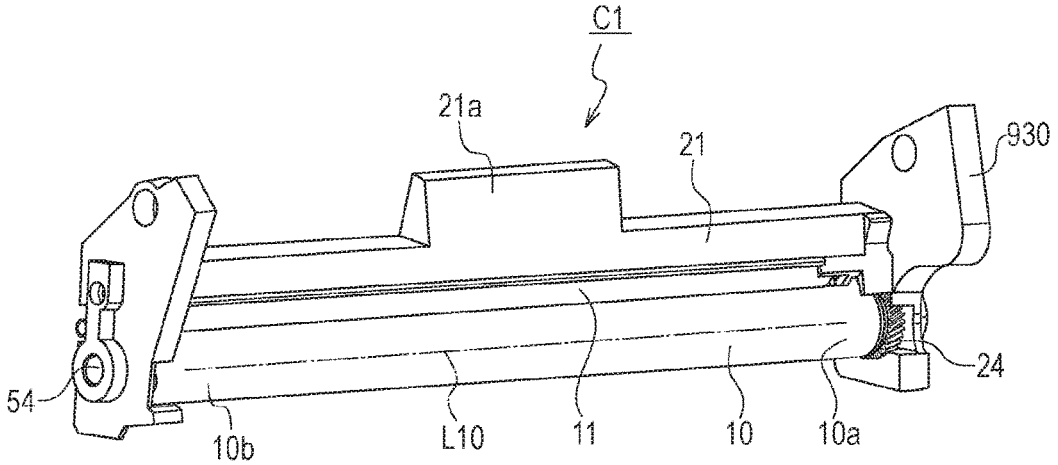
FIGS. 7A and 7B are perspective views of a drum unit of the process cartridge according to the embodiment of the disclosure.
Figure 7B:
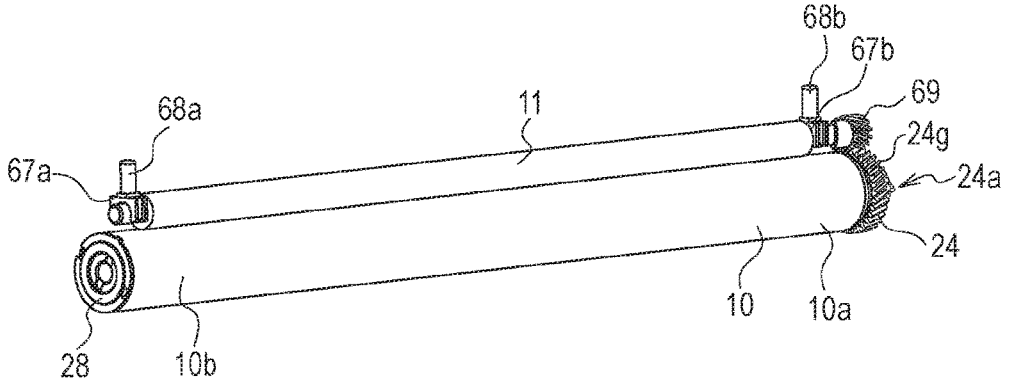

Next, a configuration of the drum unit C1 will be described with reference to FIGS. 7A and 7B. FIG. 7A is an explanatory perspective view of the drum unit C1 as seen from the non-driving side. FIG. 7B is an explanatory perspective view in which the drum support frame 21, a driving side drum bearing 930, a drum shaft 54, and the like are not illustrated for explanation of peripheral portions of the photosensitive drum 10 and the charging roller 11. As illustrated in FIGS. 7A and 7B, the drum unit C1 includes the photosensitive drum 10, the charging roller 11, and the like. The charging roller 11 is rotatably supported by charging roller bearings 67*a* and 67*b* and is urged toward the photosensitive drum 10 by charging roller urging members 68*a* and 68*b*.

A driving side flange 24 is integrally fixed to a driving side end portion 10*a* of the photosensitive drum 10, and a non-driving side flange 28 is integrally fixed to a non-driving side end portion 10*b* of the photosensitive drum 10. The driving side flange 24 and the non-driving side flange 28 are fixed coaxially with the photosensitive drum 10 by means of clamping, bonding, or the like. At both longitudinal end portions of the drum support frame 21, the driving side drum bearing 930 is fixed to an end portion on the driving side and the drum shaft 54 is fixed to an end portion on the non-driving side by means of screws, bonding, press-fitting, or the like. The driving side flange 24 integrally fixed to the photosensitive drum 10 is rotatably supported by the driving-side drum bearing 930 and the non-driving side flange 28 is rotatably supported by the drum shaft 54.

A charging roller gear 69 is provided in one longitudinal end of the charging roller 11 and the charging roller gear 69 meshes with a gear portion 24*g* of the driving side flange 24. A driving side end portion 24*a* of the driving side flange 24 is configured to receive the rotary force from the side of the image forming apparatus main body A1 (not illustrated). Therefore, as the photosensitive drum 10 is driven to rotate, the charging roller 11 is also driven to rotate. As described above, a peripheral speed of the surface of the charging roller 11 is set to be about 105 to 120% relative to a peripheral speed of the surface of the photosensitive drum 10.

The drum support frame 21 is provided with a first grip 21*a* (first grip portion) as a grip to be gripped by a user when the process cartridge P is attached. The first grip 21*a* is at a center part in an axial direction of the rotational axis L10 of the photosensitive drum 10 and provided so as to protrude from the drum support frame 21.

Unification of Development Unit B1 and Drum Unit C1

Figure 8A:
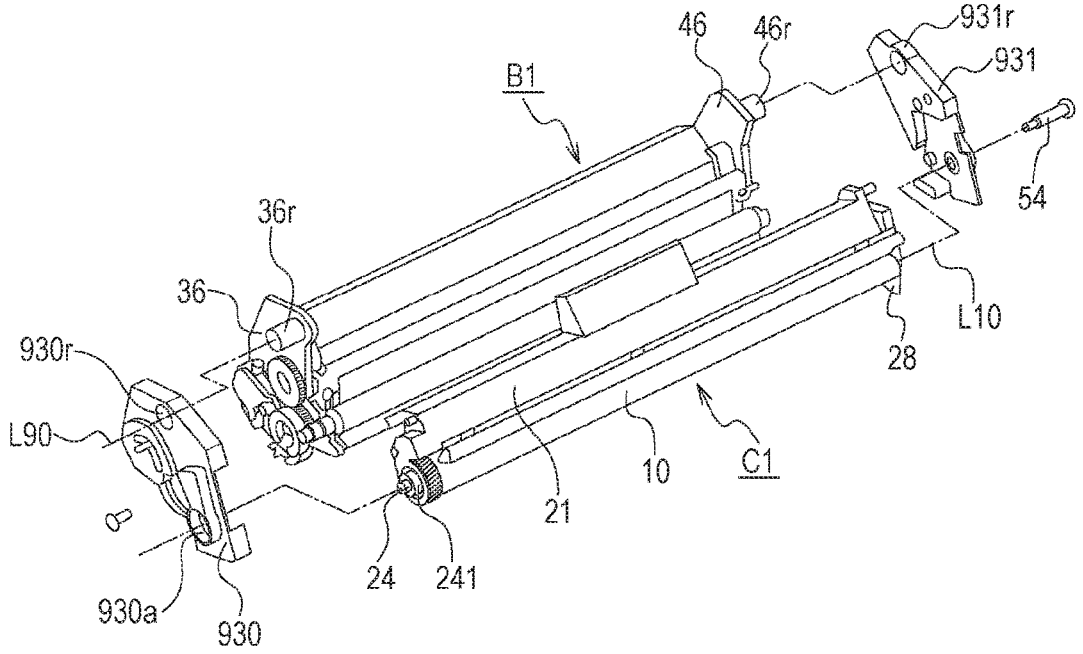
FIGS. 8A and 8B are exploded perspective views of the process cartridge according to the embodiment of the disclosure.
Figure 8B:
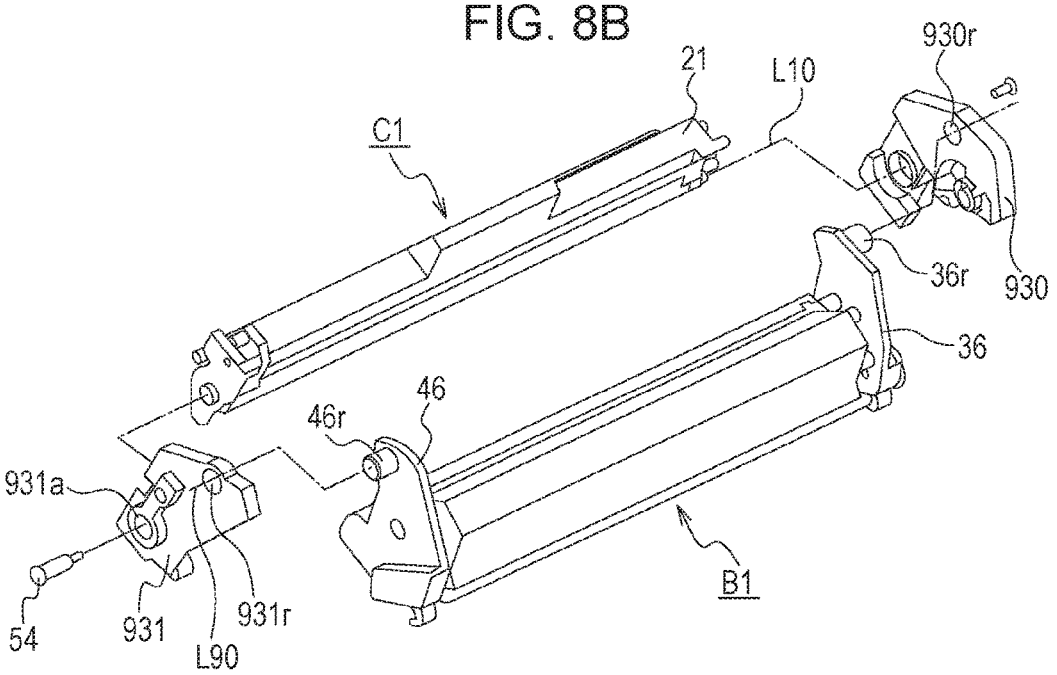

Next, a configuration in which the development unit B1 and the drum unit C1 are unified into the process cartridge P will be described with reference to FIGS. 8A and 8B. FIG. 8A is an explanatory perspective view of the process cartridge P as seen from a side of the photosensitive drum 10. FIG. 8B is an explanatory perspective view of the process cartridge P as seen from a side opposite to the photosensitive drum 10.

As illustrated in FIGS. 8A and 8B, at both longitudinal end portions of the drum support frame 21, the driving side drum bearing 930 is fixed to the end portion on the driving side and the non-driving side drum bearing 931 is fixed to the end portion on the non-driving side by means of screws, bonding, press-fitting, or the like. Specifically, a supported portion 24*f* of the driving side flange 24 that is integrally fixed to the photosensitive drum 10 is supported by a hole portion 930*a* of the driving side drum bearing 930. Moreover, the drum shaft 54 is inserted into a supported portion 28*f* (not illustrated) of the non-driving side flange 28 and a hole portion 931*a* of the non-driving side drum bearing 931 to be supported. As a result, the photosensitive drum 10 is rotatably supported by the driving side flange 24 and the non-driving side flange 28.

Further, in the development unit B1, a hang boss 36*r* provided on the driving side development bearing 36 is rotatably supported by a hang hole 930*r* provided in the driving side drum bearing 930. In addition, a hang boss 46*r* provided on the non-driving side development bearing 46 is rotatably supported by a hang hole 931*r* provided in the non-driving side drum bearing 931. With such configurations, the development unit B1 is configured to be swingable relative to the drum unit C1 with the hang boss 36*r* of the driving side development bearing 36 and the hang boss 46*r* of the non-driving side development bearing 46 as an axis L90 (FIGS. 8A and 8B). At this time, the development, unit B1 in a free state (spontaneous state) is always urged toward the drum unit C1 by a development urging member (for example, twisted coil spring) so that the development roller 13 contacts the photosensitive drum 10 (not illustrated). As a method of urging the development unit B1, a method of providing a spring between the drum unit C1 and the development unit B1, a method of utilizing weight of the development unit B1 per se, and the like are considered, but the method is not limited.

(5) Detailed Description of Storage Portion for Toner Cartridge T of Development Unit B1

Figure 9A:
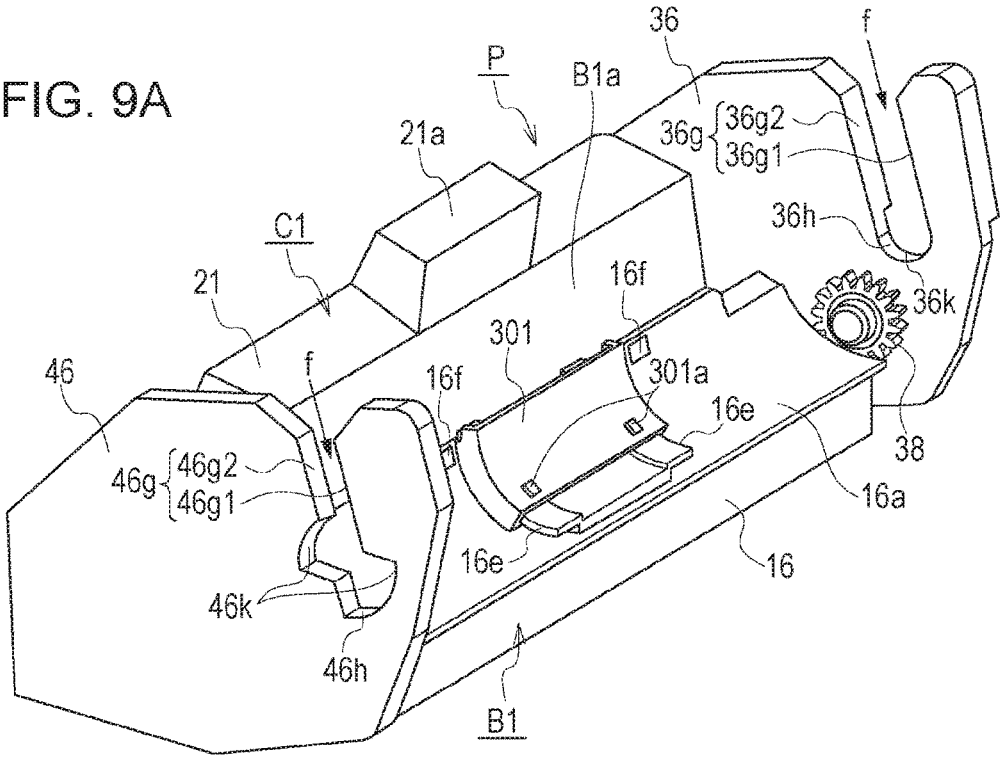
FIGS. 9A and 9B are perspective views of the process cartridge according to the embodiment of the disclosure.
Figure 9B:
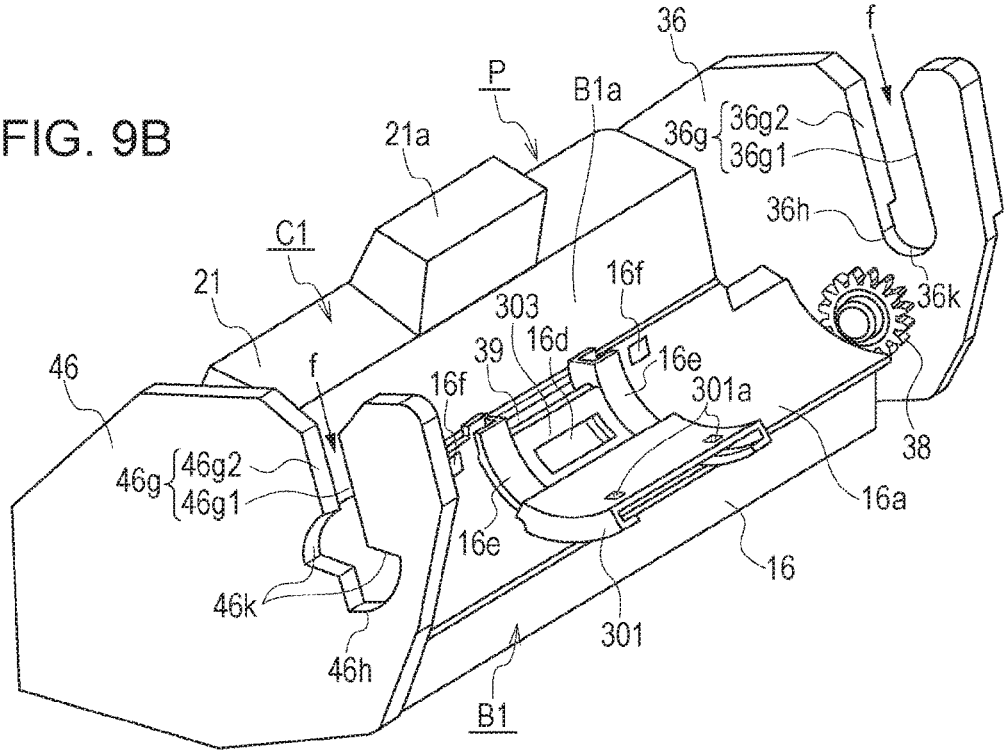

A detailed configuration of the neighborhood of a receiving portion for the toner cartridge T of the development unit B1 according to the present embodiment will be described with reference to FIGS. 9A and 9B. FIGS. 9A and 9B are perspective views of the process cartridge P in the neighborhood of a storage portion for the toner cartridge T, in which FIG. 9A illustrates a state where a development shutter 301 is closed and FIG. 9B illustrates a state where the development shutter 301 is opened.

A toner cartridge storage portion B1*a* is provided in the development unit B1. The toner cartridge storage portion (attachment portion) B1*a* is disposed between the drum support frame 21 and the developer containing portion 16*a*. In the neighborhood of the toner cartridge storage portion B1*a*, the development unit B1 has a receiving opening portion (first opening) 16*d* and the development shutter 301 (first shutter) and the receiving opening portion 16*d* is provided at a longitudinal center part of the development frame 16. Note that, the position of the receiving opening portion 16*d* is not limited thereto as long as being at a position opposed to a supply opening portion 200 described below. The receiving opening portion (first opening) 16*d* is sealed by the development shutter 301 (described below) in a shape having curvature along an outer peripheral surface of the toner cartridge T as illustrated in FIG. 9A.

The development shutter 301 is provided with a hole portion 301*a* engaged with a projection portion (abutting portion) 205 (described below) that is provided on the toner cartridge T, so that the hole portion 301*a* is disposed at a position out of a sealing range in which the development shutter 301 seals the receiving opening portion 16*d*. The development shutter 301 is engaged with a development shutter guide portion 16*e* provided at each longitudinal end portion of the receiving opening portion 16*d*. In this manner, the development shutter 301 is configured to be slidable along the development shutter guide portion 16*e* between a state (FIG. 9A) where the receiving opening portion 16*d* is closed and a state (FIG. 9B) where the receiving opening portion 16*d* is opened. Additionally, a receiving opening seal 303 for sealing a space between the development shutter 301 and the receiving opening portion 16*d* is provided on the development frame 16 side so as to surround the receiving opening portion 16*d*.

The driving side development bearing 36 of the development unit B1 has an insertion guide 36*g* that guides an insertion trajectory of the toner cartridge T and an abutted portion 36*h* (described below) that abuts to the abutting portion 205 of the toner cartridge T when the toner cartridge T is inserted. Similarly, the non-driving side development bearing 46 of the development unit B1 has an insertion guide 46*g* that guides an insertion trajectory of the toner cartridge T and an abutted portion 46*h* (described below) that abuts to an abutting portion 204 of the toner cartridge T when the toner cartridge T is inserted.

An opening and closing guide portion 36*k* and an opening and closing guide portion 46*k* are respectively provided in the driving side development bearing 36 and the non-driving side development bearing 46 in order to guide the toner cartridge T when the development shutter 301 and a toner shutter 201 described below are opened or closed. Here, the insertion guide 36*g* and the insertion guide 46*g* are formed linearly in parallel to each other along an inserting direction f (FIG. 9A) of the toner cartridge T. The abutted portion 36*h* and the opening and closing guide portion 36*k* are provided in a downstream side with respect to the inserting direction f of the insertion guide 36*g* and the abutted portion 46*h* and the opening and closing guide portion 46*k* are provided in a downstream side with respect to the inserting direction f of the insertion guide 46*g*.

In the development unit B1, a first drive transmitting portion 38 (described below) for transmitting drive to a toner feeding unit 206 of the toner cartridge T is provided at one longitudinal end portion of the development unit D1. Though not illustrated, the first drive transmitting portion 38 is connected by a gear with a driving mechanism of the image forming apparatus main body A1 inside the development unit B1.

A hole portion 16*f* is provided at an outside of each longitudinal end of the receiving opening portion 16*d* of the development unit D1. Therefore, when the hole portion 16*f* is engaged with a claw portion 201*b* of a snap-fit portion 201*a* (described below) provided in the toner shutter 201 of the toner cartridge T and the toner shutter 201 closed, the toner shutter 201 is prevented from rotating together with a toner frame 40 described below.

(7) Description of Configuration of Toner Cartridge T

Figure 10A:
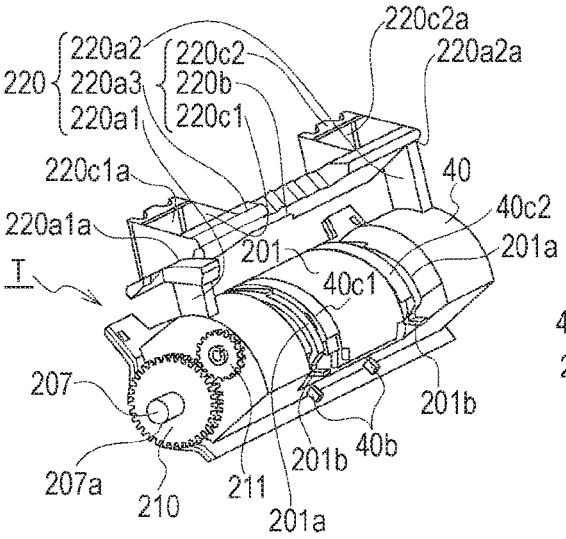
FIGS. 10A to 10D are explanatory views related to the toner cartridge attached to the process cartridge according to the embodiment of the disclosure.
Figure 10B:
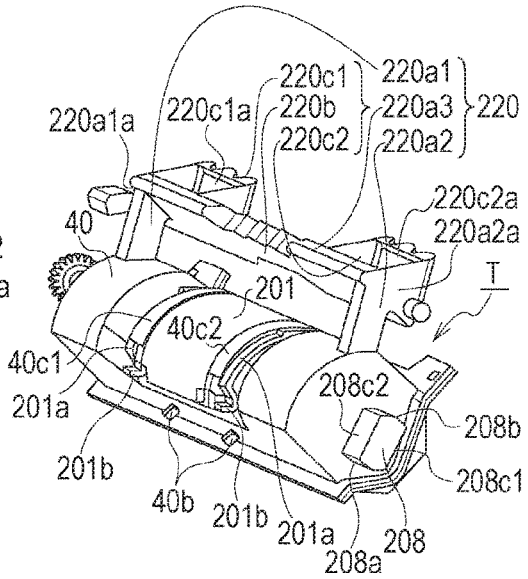
Figure 10C:
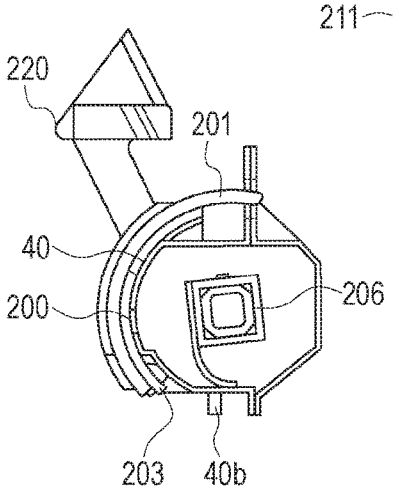
Figure 10D:
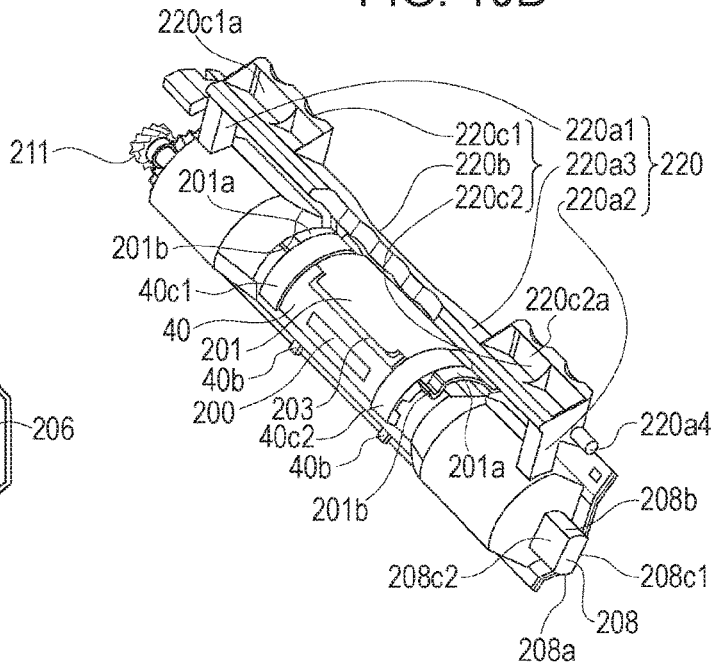

Next, a detailed configuration of the toner cartridge T according to the present embodiment will be described with reference to FIGS. 10A to 10D. FIG. 10A is a perspective view of the toner cartridge T as seen from the driving side and FIG. 10B is a perspective view of the toner cartridge T as seen from an opposite side of the driving side. FIG. 10C is a cross-sectional view of the toner cartridge T as seen from the opposite side of the driving side and FIG. 10D is a perspective view of a state where the toner shutter 201 of the toner cartridge T is opened.

The toner cartridge T has the toner frame 40, the supply opening portion (second opening) 200, and the toner shutter (second shutter) 201. In the toner shutter 201, a toner discharge port seal 203 that seals a space between the toner frame 40 and the toner shutter 201 when the toner shutter 201 is at a closing position where the supply opening portion 200 is closed is attached so as to cover the supply opening portion 200.

The toner frame 40 has a substantially cylindrical hollow shape and is provided, on an outer periphery thereof, with a projection portion 40*b* that is engaged with the hole portion 301*a* of the development shutter 301. A toner feeding member 206 for feeding toner is provided inside the toner frame 40. At one end of the toner feeding member 206, a toner feeding driving portion 210 that drives the toner feeding member 206 and a second drive transmitting portion 211 (drive receiving portion) that transmits drive of the first drive transmitting portion 38 (drive transmitting portion) of the process cartridge P to the toner feeding driving portion 210 are provided.

The supply opening portion 200 is provided in a longitudinal center part of the toner cartridge T on a circumference of the toner frame 40. Here, the longitudinal direction of the toner cartridge T refers to a rotational axial direction of the toner feeding member 206. Note that, the position of the supply opening portion 200 is not limited thereto as long as being at a position opposed to the receiving opening portion 16*d*.

The toner shutter 201 has a shape having curvature along the outer peripheral surface of the toner cartridge T and has the snap-fit portion 201*a* and the claw portion 201*b* at each longitudinal end portion. The toner shutter 201 is engaged with toner shutter guide portions 40*c*1 and 40*c*2 that are provided at both longitudinal ends of the supply opening portion 200. The toner shutter 201 is configured to be slidable in a circumferential direction of the toner frame 40 between a state (FIG. 10D) where the supply opening portion 200 is opened along the outer peripheral surface of the toner cartridge T and a state (FIG. 10B) where the supply opening portion 200 is closed.

The toner cartridge T is provided, at both longitudinal end portions of the toner cartridge T, with an insertion guided portion 207 and an insertion guided portion 208 which are guided by the insertion guide 36*g* and the insertion guide 46*g* of the development unit B1. The insertion guided portion 207 has an abutting portion 207*a* that abuts to the abutted portion 36*h* of the development unit B1 when the toner cartridge T is inserted.

The insertion guided portion 208 has an abutting portion 208*a* that abuts to the abutted portion 46*h* of the development unit B1 when the toner cartridge T is inserted, and an opening and closing guided portion 208*b* that guides the toner cartridge T when the toner shutter 201 is opened or closed. Additionally, the insertion guided portion 208 is provided with a regulation portion 208*c*1 and a regulation portion 208*c*2 that regulate an insertion attitude of the toner cartridge T upon insertion.

Note that, the abutting portion 207*a* and an opening and closing guided portion 207*b* are formed integrally with the insertion guided portion 207 in the present embodiment, however, they may be separate members as long as the respective functions are achieved.

Further, the insertion guided portion 207 is provided at an end portion of the second drive transmitting portion 211 in the longitudinal direction of the toner feeding member 206 in the present embodiment, but may be provided in the toner frame 40. The abutting portion 208*a*, the opening and closing guided portion 208*b*, the regulation portion 208*c*1, and the regulation portion 208*c*2 are formed integrally with the insertion guided portion 208, however, they may be separate members as long as the respective functions are achieved.

As illustrated in FIGS. 10A to 10D, the toner frame 40 is provided with a second grip 220 (second grip portion) to be gripped by a user when the toner cartridge T is attached. The second grip 220 has a shape in which one end portion 220*a*1, the other end portion 220*a*2, and a base portion 220*a*3 are sequentially connected. The one end portion 220*a*1 and the other end portion 220*a*2 are provided so as to protrude from one longitudinal end portion and the other longitudinal end portion of the toner frame 40 in a direction intersecting the longitudinal direction. The base portion 220*a*3 is provided along the longitudinal direction of the toner frame 40 so as to connect a leading end portion 220*a*1*a* of the one end portion 220*a*1 and a leading end portion 220*a*2*a* of the other end portion 220*a*2. The base portion 220*a*3 has a first portion 220*b* that is used for the user to grip the toner cartridge T, and a second portion 220*c*1 and a second portion 220*c*2 are respectively provided at one end side and the other end side of the first portion 220*b*.

Figure 1A:
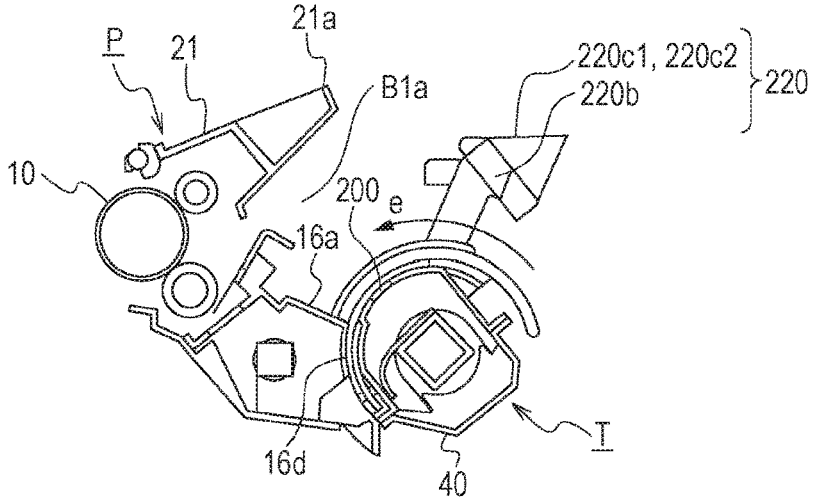
FIGS. 1A and 1B are side views of a process cartridge and a toner cartridge according to an embodiment of the disclosure and FIG. 1C is a perspective view thereof.
Figure 1B:
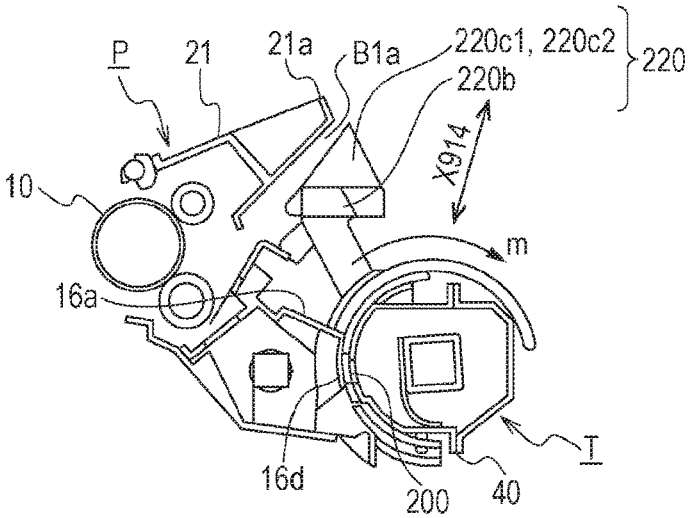
Figure 1C:
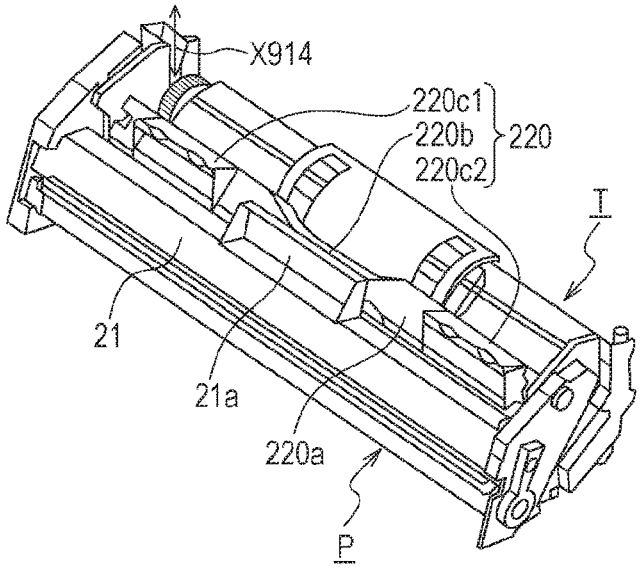

As illustrated in FIG. 1C, the first portion 220*b* is disposed at a longitudinal center part of a base portion 220*a* and corresponds to a longitudinal position opposed to the first grip 21*a* of the process cartridge P when the toner cartridge T is attached to the process cartridge P.

The second portion 220*c*1 is arranged between the first portion 220*b* and the one end portion 220*a*1 and the second portion 220*c*2 is arranged between the first portion 220*b* and the other end portion 220*a*2 (refer to FIGS. 10A, B, and D). The second portion 220*c*1 and the second portion 220*c*2 are positioned at both longitudinal ends of the first grip 21*a* and arranged at longitudinal positions where the second portion 220*c*1 and the second portion 220*c*2 do not overlap with the first grip 21*a* when the toner cartridge T is attached to the process cartridge P. Moreover, the second portion 220*c*1 and the second portion 220*c*2 are provided so as to further protrude from the toner frame 40 beyond the first portion 220*b* in a direction intersecting the longitudinal direction (refer to FIG. 1C).

Note that, the configuration is such that the second portion 220*c*1 and the second portion 220*c*2 are provided at both end portions of the first portion 220*b* in the present embodiment, but either the second portion 220*c*1 or the second portion 220*c*2 may be provided at only corresponding one of the end portions.

(8) Attachment Operation of Toner Cartridge T to Process Cartridge P

First, an operation according to the present embodiment from when the toner cartridge T is inserted in the process cartridge till when the toner cartridge T is engaged with the process cartridge P and the receiving opening portion 16*d* and the supply opening portion 200 are opened will be described.

Insertion Operation of Toner Cartridge T into Process Cartridge P

Figure 11A:
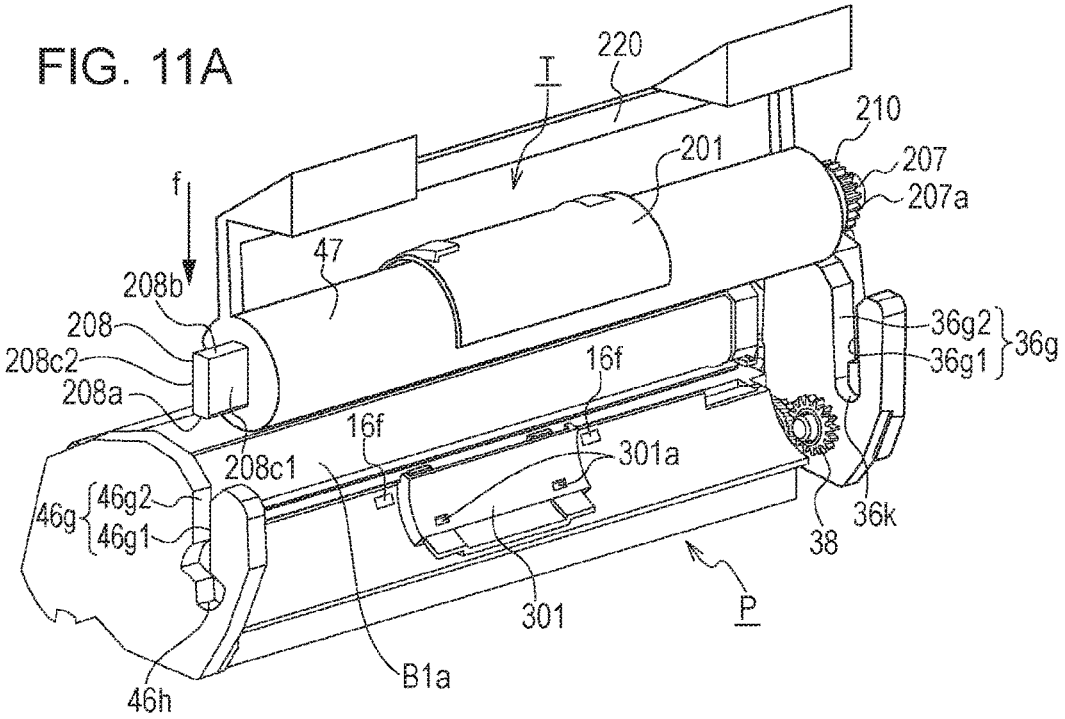
FIGS. 11A and 11B are explanatory views illustrating start of insertion of the toner cartridge into the process cartridge according to the embodiment of the disclosure.
Figure 11B:
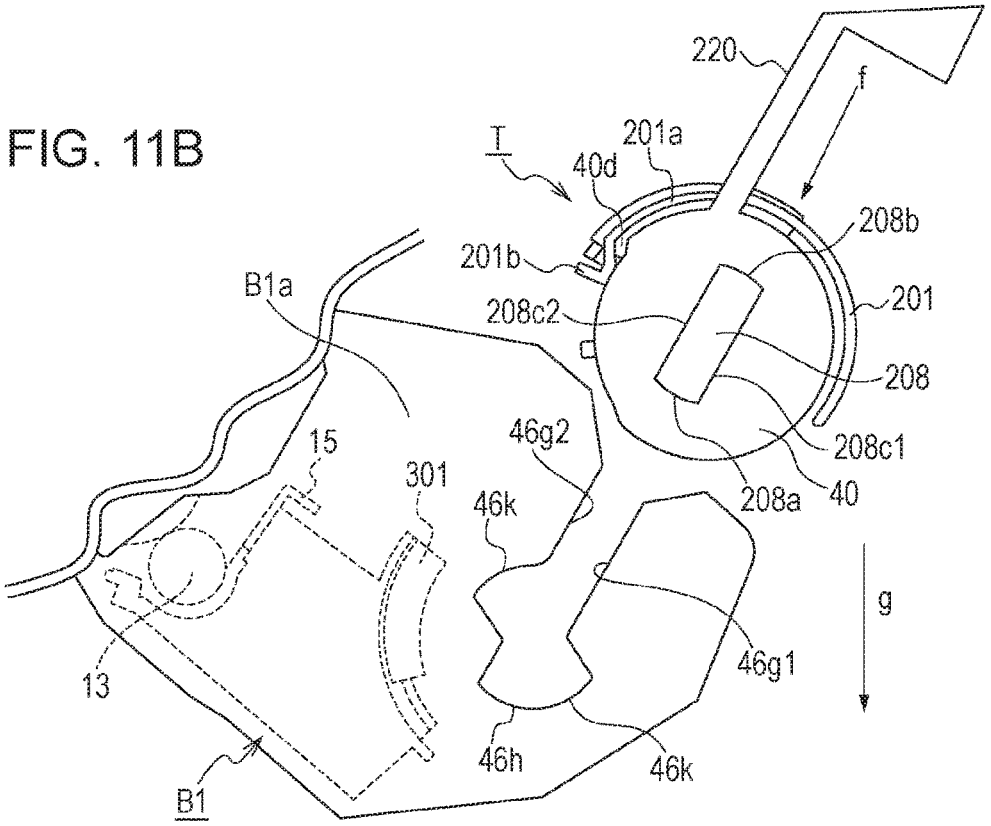
Figure 12:
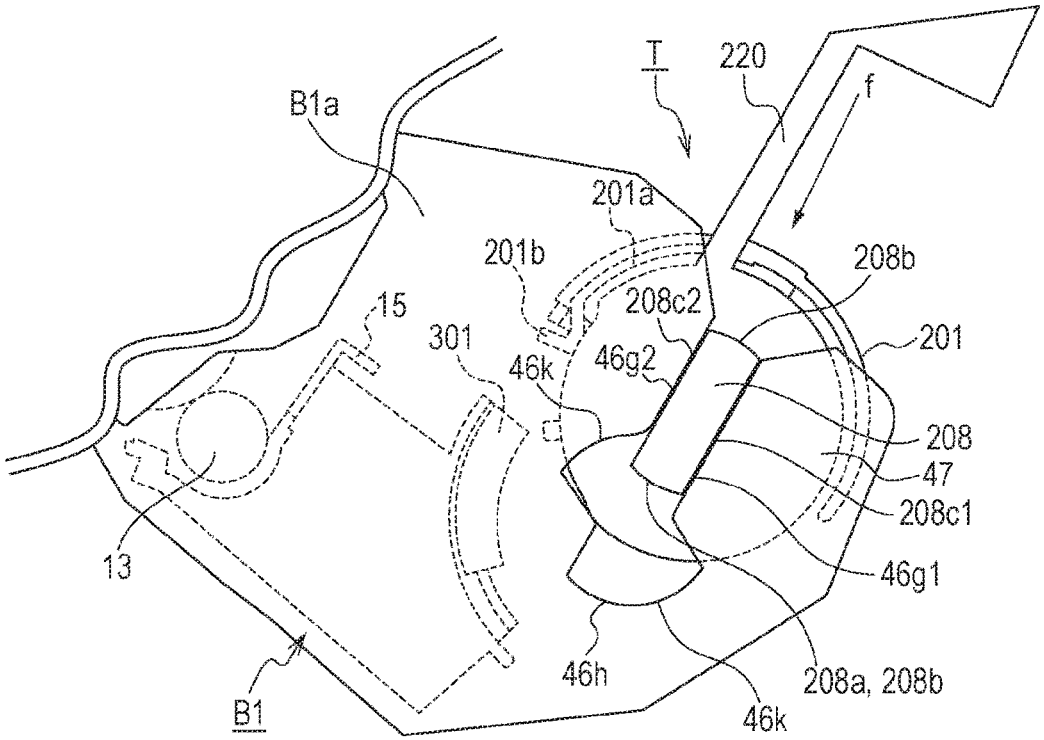
FIG. 12 is a side view illustrating a state in partway of insertion of the toner cartridge into the process cartridge according to the embodiment of the disclosure.
Figure 13A:
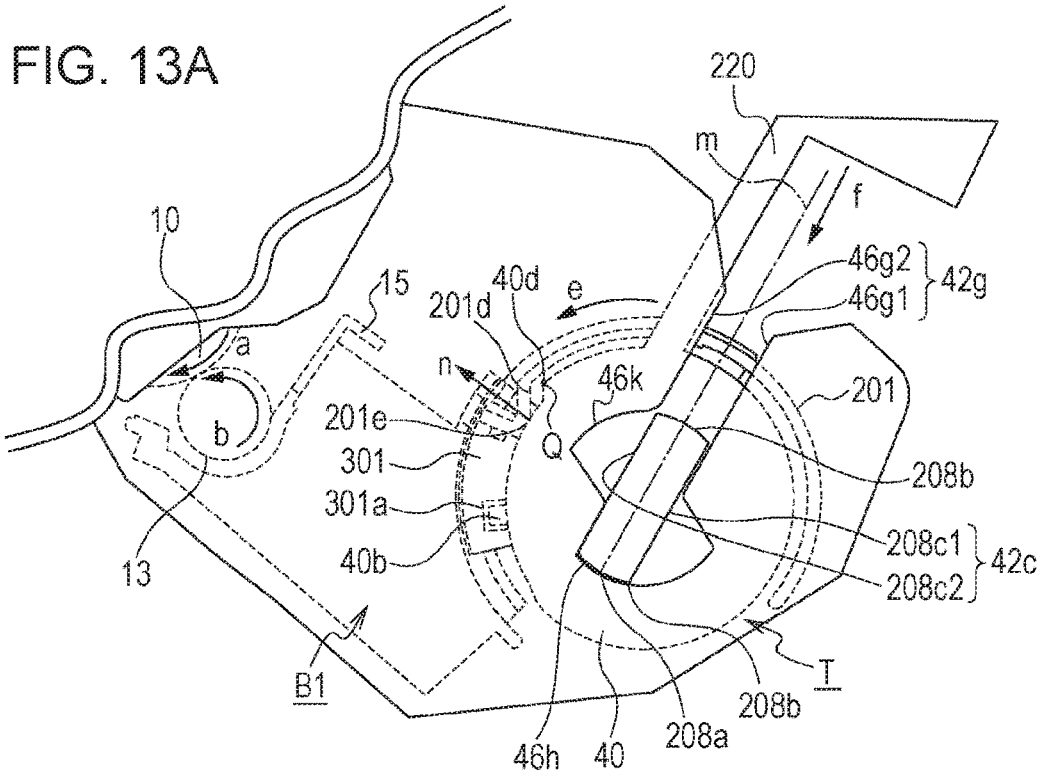
FIGS. 13A and 13B are side views illustrating completion of insertion of the toner cartridge into the process cartridge according to the embodiment of the disclosure.

First, an insertion operation of the toner cartridge T into the process cartridge P will be described with reference to FIGS. 11A, 11B, 12, 13A, and 13B. FIG. 11A is an explanatory perspective view illustrating insertion of the toner cartridge T, FIG. 11B is a side view illustrating insertion of the toner cartridge T, and FIG. 12 is a side view illustrating a state in partway of insertion of the toner cartridge T. FIG. 13A is a side view of the toner cartridge T and illustrates a positional relationship between the second grip 220 and the abutting portion 208*a* in an attaching direction, and FIG. 13B is a side view of the toner cartridge T and illustrates a positional relationship between the second grip 220 and the abutting portion 207*a* in the attaching direction.

In a case where the toner cartridge T is attached to the toner cartridge storage portion B1*a*, with the development shutter 301 and the toner shutter 201, the receiving opening portion 16*d* of the development unit B1 and the supply opening portion 200 of the toner cartridge T are positioned in closed states.

An inserting direction of the toner cartridge T into the process cartridge P is a direction (the direction f in FIG. 11B) in which the abutting portion 208*a* is on a downstream side with respect to the insertion guided portion 208 along the regulation portions 208*c*1 and 208*c*2 as seen from a longitudinal side surface of the toner cartridge T. As illustrated in FIG. 11A, the user grips the second grip 220 and moves the toner cartridge T toward the process cartridge P in the inserting direction f. At this time, the user moves the toner cartridge T so that the insertion guided portion 208 of the toner cartridge T and the insertion guide 46*g* of the development unit B1 are engaged with each other and the insertion guided portion 207 and the insertion guide 36*g* are engaged with each other. At this time, the toner cartridge T is inserted so that the insertion guided portion 208 has an attitude to extend in a direction intersecting a gravitational direction g (FIG. 11B). Thereby, the toner cartridge T is inserted in a state where the regulation portion 208*c*1 faces a guide surface 46*g*1 of the insertion guide 46*g* and the regulation portion 208*c*2 positioned to be opposed to the regulation portion 208*c*1 faces a guide surface 46*g*2 of the insertion guide 46*g*. As a result, with the regulation portion 208*c*1 in the gravitational direction g and the guide surface 46*g*1 of The insertion guide 46*g*, the attitude of the toner cartridge T relative to the development unit B1 is decided as illustrated in FIG. 12. While keeping the attitude, the user further moves the toner cartridge T downwardly in the gravitational direction g along the insertion guide 46*g* and the insertion guide 36*g*, so that the toner cartridge T is inserted in the development unit B1 along the direction of the arrow f.

Figure 13B:
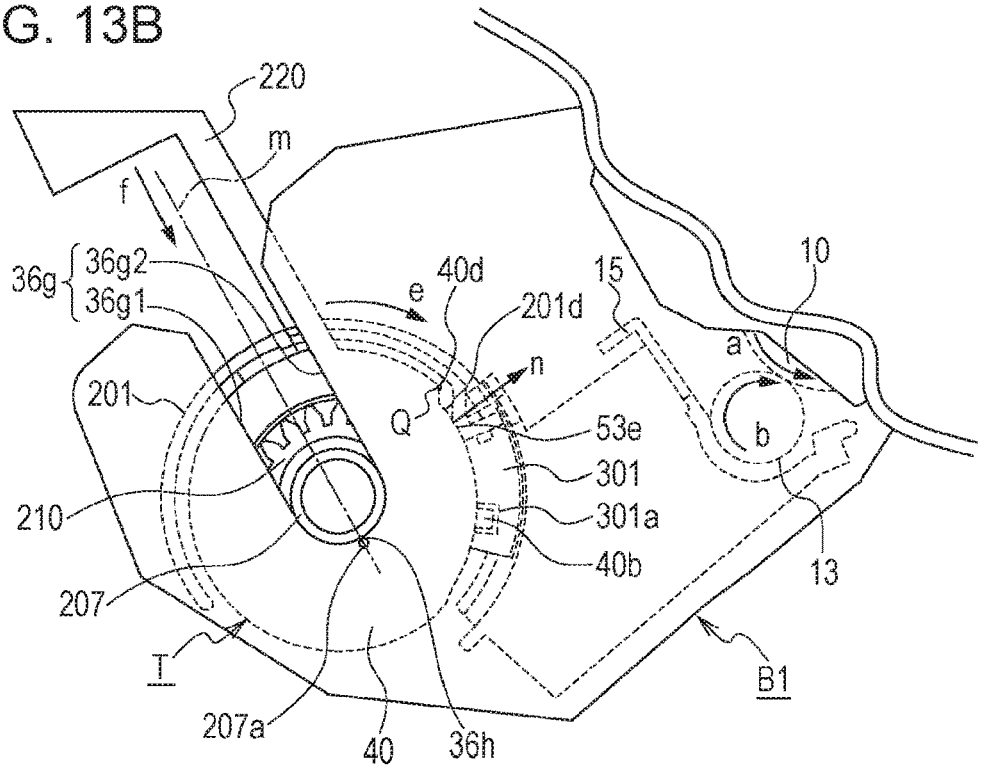

When the user moves the toner cartridge T in the direction of the arrow f along the insertion guide 46*g* and the insertion guide 36*g*, the abutting portion 208*a* abuts to the abutted portion 46*h* and the abutting portion 207*a* abuts to the abutted portion 36*h*, resulting in completion of the insertion (FIGS. 13A and 13B)

Positioning of Toner Cartridge T with Respect to Process Cartridge P

Figure 14A:
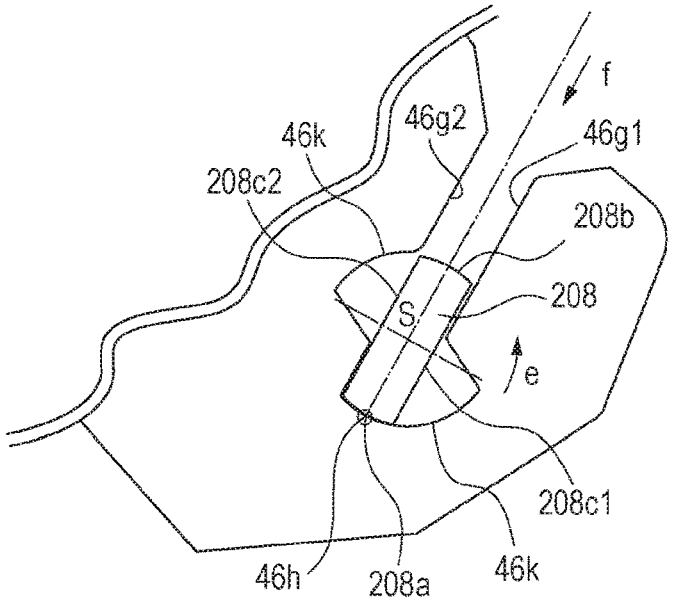
FIGS. 14A and 14B are explanatory views illustrating completion of insertion of the toner cartridge into the process cartridge according to the embodiment of the disclosure.
Figure 14B:
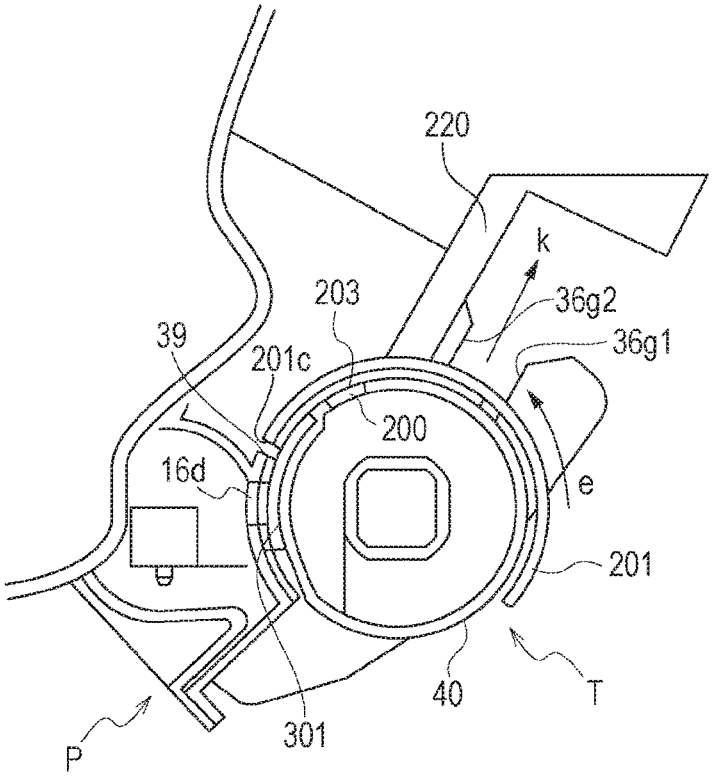
Figure 15A:
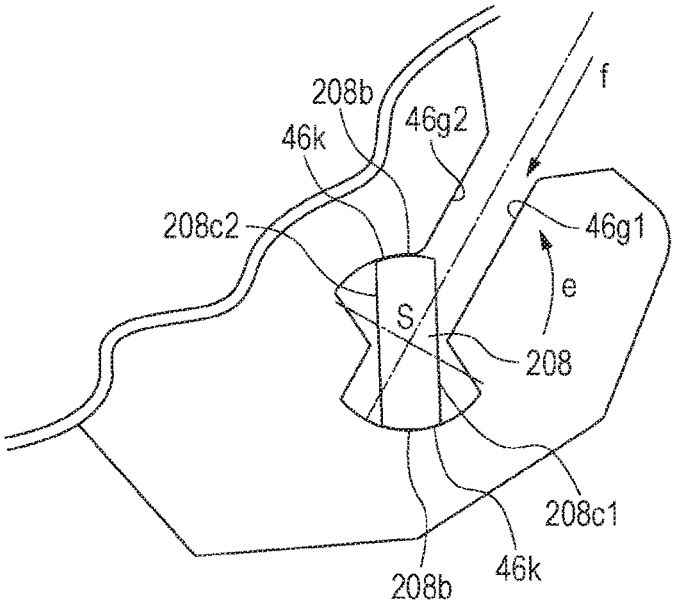
FIGS. 15A to 15C are explanatory views illustrating a state in partway of rotation for attachment of the toner cartridge into the process cartridge according to the embodiment of the disclosure.
Figure 15B:
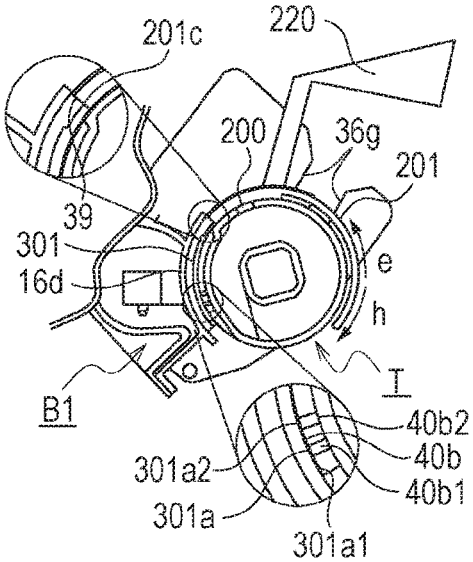
Figure 15C:
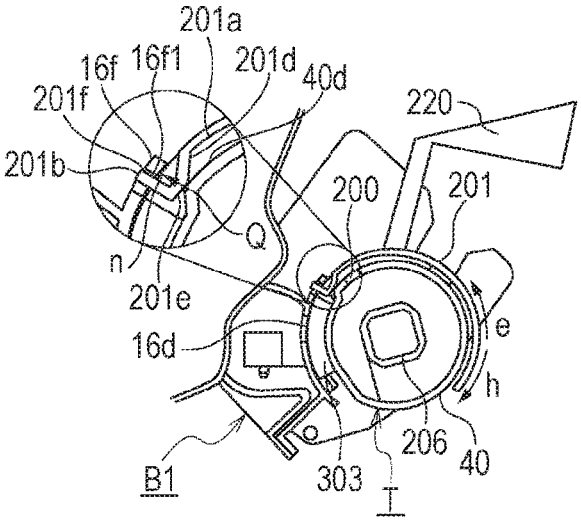

Next, positioning of the toner cartridge T with respect to the process cartridge P will be described with reference to FIGS. 14A, 14B, and 15A to 15C. FIG. 14A is a side view of the toner cartridge T in a state (first position) where the abutting portion 208*a* abuts to the abutted portion 46*h* and FIG. 14B is a cross-sectional view of the toner cartridge T in the state where the abutting portion 208*a* abuts to the abutted portion 46*h*. FIG. 15A is a side view illustrating a state where the toner cartridge T is positioned with respect to the process cartridge P. FIG. 15B is a cross-sectional view illustrating an engagement relationship between the positioned toner cartridge T and the process cartridge P and FIG. 15C is a cross-sectional view illustrating another engaged state between the positioned toner cartridge T and the process cartridge P.

The toner cartridge T inserted in the development unit B1 causes the toner frame 40 to rotate in a counterclockwise manner (a direction of an arrow e in FIGS. 14A and 14B) as seen from FIGS. 14A and 14B by the second grip 220. Then, in the toner cartridge T, as illustrated in FIG. 15A, the opening and closing guided portion 208*b* is engaged with the opening and closing guide portion 46*k* and the position of the toner cartridge T relative to the process cartridge P is decided.

Opening Operations of Shutters

Figure 16A:
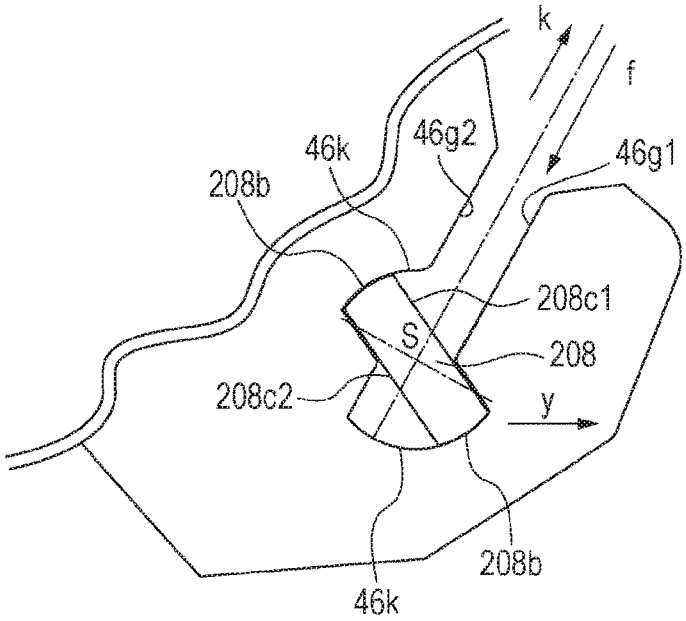
FIGS. 16A and 16B are explanatory views illustrating completion of rotation for attachment of the toner cartridge into the process cartridge according to the embodiment of the disclosure.
Figure 16B:
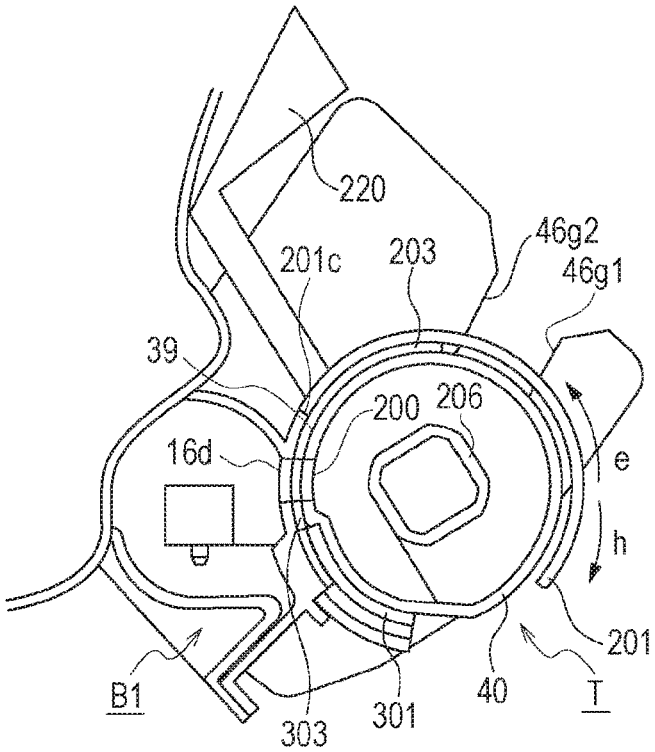

Next, opening operations of the development shutter 301 of the development unit B1 and the toner shutter 201 of the toner cartridge T will be described with reference to FIGS. 13A, 15A to 15C, 16A, and 16B. FIG. 16A is a side view of the toner cartridge T that is attached to the process cartridge P when the receiving opening portion 16*d* and the supply opening portion 200 are opened and FIG. 16B is a cross-sectional view illustrating a state where the receiving opening portion 16*d* and the supply opening portion 200 are opened. FIGS. 16A and 16B are a side view and a cross-sectional view of the process cartridge P and the toner cartridge T when the toner cartridge T is at a second position.

As illustrated in FIG. 15A, the toner cartridge T is positioned with respect to the process cartridge P, and the toner cartridge T is further rotated (moved) in the direction of the arrow e by the second grip 220. Then, as illustrated in FIG. 15B, a leading end surface 201*c* (refer to FIG. 10D) of the toner shutter 201 abuts to a collision surface 39 (refer to FIG. 9B) of the development unit B1. Thereby, rotation of the toner shutter 201 is regulated. Moreover, the projection portion 40*b* of the toner frame 40 is engaged with the hole portion 301*a* of the development shutter 301. With further rotation in such a state, the rotation of the toner shutter 201 is regulated, so that the toner frame 40 relatively moves to the toner shutter 201 in a direction in which the supply opening portion 200 is opened. At this time, a surface 40*b*1 of the projection portion 40*b* contacts a surface 301*a*1 of the hole portion 301*a* and the development shutter 301 is pressed by the projection portion 40*b* of the toner frame 40. As a result, the toner shutter 201 rotates in interrelation with the toner frame 40 and the receiving opening portion 16*d* is opened. Further, in the snap-fit portion 201*a* of the toner shutter 201, a point Q of a surface 40*d* on an outer peripheral surface of the toner frame 40, which is opposed to the snap-fit portion 201*a*, contacts a surface 201*e* along a surface 201*d* of the snap-fit portion 201*a* (FIGS. 13A and 15C). At this time, the surface 201*e* is deformed in a direction of an arrow n by receiving a force in the direction of the arrow n from the point Q. Then, with the rotation, the claw portion 201*b* is engaged with a hole portion 16*f* of the development unit B1.

After that, in a state where the supply opening portion 200 is in communication with the receiving opening portion 16*d* as illustrated in FIG. 16B, the opening of the receiving opening portion 16*d* and the supply opening portion 200 is completed. At this time, in a state where the receiving opening portion 16*d* and the supply opening portion 200 are opened, the toner cartridge T regulates movement in a force direction y from the process cartridge P and in a direction k opposite to the inserting direction f by engagement between the opening and closing guided portion 208*b* and the opening and closing guide portion 46*k* (FIG. 16A). Further, when the state of FIGS. 11A and 11B is brought into a state where the position of the toner cartridge T with respect to the process cartridge P is regulated, the second drive transmitting portion 211 is connected to the first drive transmitting portion 38, so that the drive transmission from the process cartridge P to the toner feeding member 206 is enabled.

Thus, circulation of the toner t2 between the toner frame 40 of the toner cartridge T and the developer containing portion 16*a* of the development unit B1 is enabled (FIG. 3).

Closing Operations of Shutters

Next, closing operations of the development shutter 301 of the development unit B1 and the toner shutter 201 of the toner cartridge T will be described with reference to FIGS. 14A, 14B, 15B, 15C, and 16B.

First, in a state of FIG. 16B, the user grips the second grip 220 to rotate the toner frame 40 in a direction of an arrow h. Then, as illustrated in FIG. 15B, a surface 40*b*2 of the projection portion 40*b* of the toner frame 40 abuts to a surface 301*a*2 of the hole portion 301*a* of the development shutter 301. Then, the development shutter 301 receives a force from the surface 301*a*2, rotates in interrelation with the toner frame 40, and closes the receiving opening portion 16*d*. At this time, as illustrated in FIG. 15C, in the toner shutter 201, the claw portion 201*b* is engaged with the hole portion 16*f* of the development unit B1. Thus, a surface 201*f* of the claw portion 201*b* abuts to a surface 16*f*1 of the hole portion 16*f*, and the toner shutter 201 does not rotate together with the toner frame 40. Accordingly, the toner frame 40 moves relative to the toner shutter 201 and the supply opening portion 200 is also closed.

When the toner frame 40 further rotates in the direction of the arrow h, the positioning of the toner cartridge T with respect to the process cartridge P is released as illustrated in FIGS. 14A and 14B and the toner cartridge T is able to be detached in a direction of an arrow k in FIG. 14B.

(9) Description of Configuration of Attaching or Detaching Process Cartridge P to or from Image Forming Apparatus Main Body A1

Next, a method of attaching or detaching the process cartridge P to or from the image forming apparatus main body A1 will be described with reference to FIGS. 17 to 19.

Figure 17:
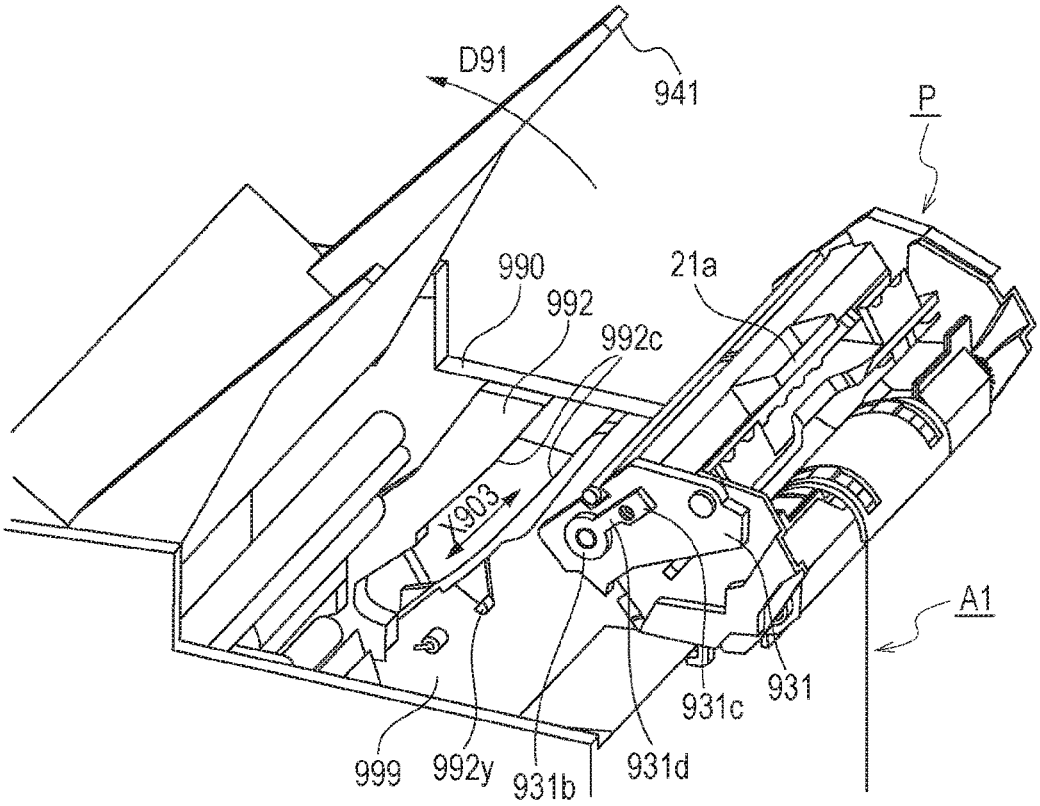
FIG. 17 is a driving side perspective view illustrating attachment of the process cartridge to an image forming apparatus main body according to the embodiment of the disclosure.
Figure 18:
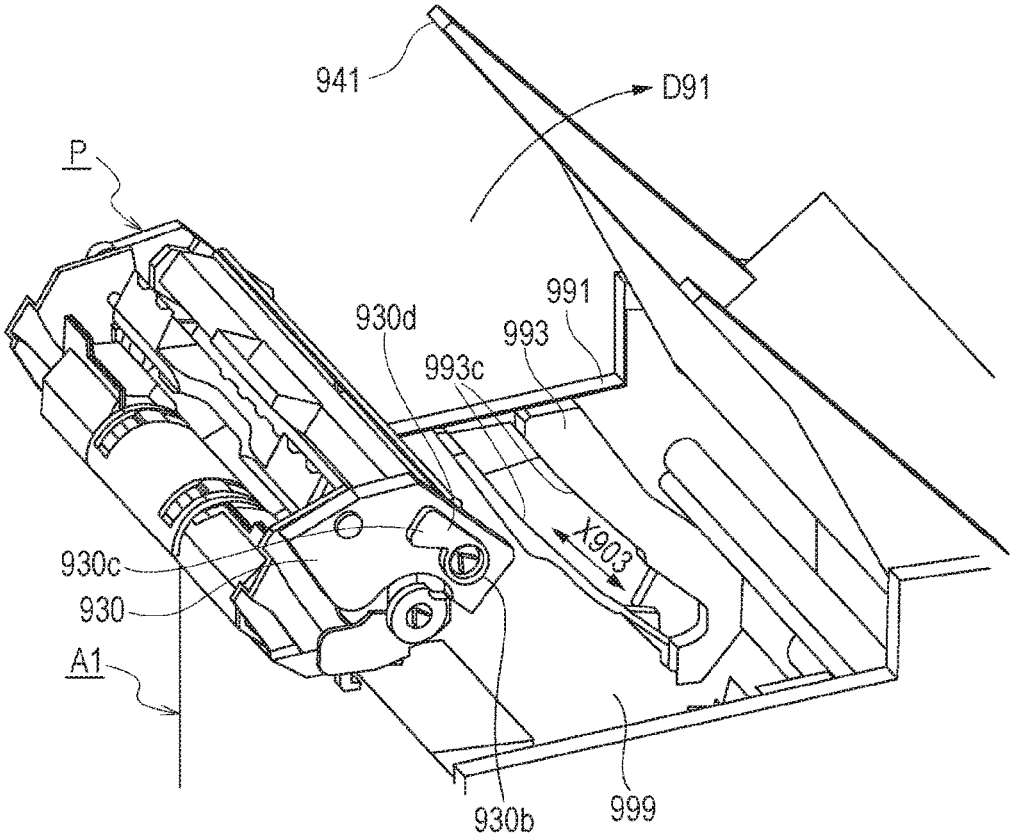
FIG. 18 is a non-driving side perspective view illustrating attachment of the process cartridge to an image forming apparatus main body according to the embodiment of the disclosure.

FIG. 17 is an explanatory perspective view of the image forming apparatus main body A1 as seen from the non-driving side and FIG. 18 is an explanatory perspective view of the image forming apparatus main body A1 as seen from the driving side. FIG. 19 is an explanatory view when attachment of the process cartridge P to the image forming apparatus main body A1 is completed. FIG. 20 is an explanatory perspective view when attachment of the process cartridge P to the image forming apparatus main body A1 is completed.

As illustrated in FIG. 17, the non-driving side drum bearing 931 is provided on the non-driving side of the process cartridge P. The non-driving side drum bearing 931 has a guided portion 931*d*. The guided portion 931*d* has a positioning portion 931*b* and a rotation stop portion 931*c*.

As illustrated in FIG. 18, the driving side drum bearing 930 is provided with a guided portion 930*d*. The guided portion 930*d* has a positioning portion 930*b* and a rotation stop portion 930*c*.

On the other hand, when an opening and closing member 941 of the image forming apparatus main body A1 is opened, a cartridge attachment portion 999 is provided, and a driving-side side plate 990 that constitutes a housing of the image forming apparatus main body A1 is provided on the driving side of the cartridge attachment portion 999 (FIGS. 17 and 18). The driving-side side plate 990 includes a driving side guide member 992. A non-driving-side side plate 991 is provided with a non-driving side guide member 993. The driving side guide member 992 includes a guide portion 992*c* and the non-driving side guide member 993 includes a guide portion 993*c*. A groove shape that extends along an attaching/detaching path X903 of the process cartridge P is formed in the guide portion 992*c* of the driving side guide member 992 and the guide portion 993*c* of the non-driving side guide member 993. The driving side guide member 992 also includes an abutting portion 992*y* that contacts a rotation regulation portion 955*y* of a coupling lever 955 (refer to FIG. 19) in a process where the process cartridge P is attached.

Attachment of Process Cartridge P to Image Forming Apparatus Main Body A1

A method of attaching the process cartridge P to the image forming apparatus main body A1 will be described. As illustrated in FIGS. 17 and 18, the opening and closing member 941 that is arranged at a top part of the image forming apparatus main body A1 and is openable and closable is rotated in an opening direction D91. Thereby, the cartridge attachment portion 999 inside the image forming apparatus main body A1 is exposed.

Then, while gripping the first grip 21*a* of the process cartridge P, the user causes the guided portion 931*d* (FIG. 17) and the guide portion 993*c* (FIG. 18) to be engaged with each other and the guided portion 930*d* (FIG. 18) and the guide portion 992*c* (FIG. 17) to be engaged with each other. Thereby, the process cartridge P is inserted in the image forming apparatus main body A1 along the attaching/detaching path X903 formed by the guide portion 992*c* of the driving side guide member 992 and the guide portion 993*c* of the non-driving side guide member 993.

Figure 19:
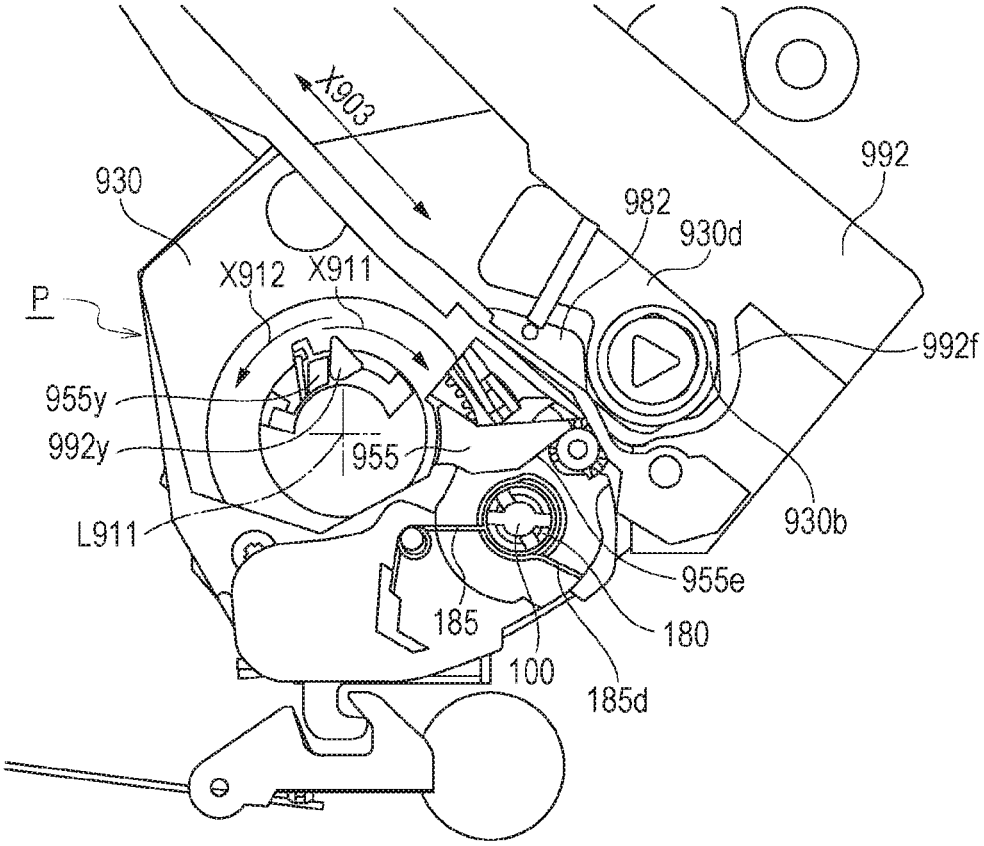
FIG. 19 is a cross-sectional side view illustrating a process where the process cartridge is attached to the image forming apparatus main body according to the embodiment of the disclosure.
Figure 20:
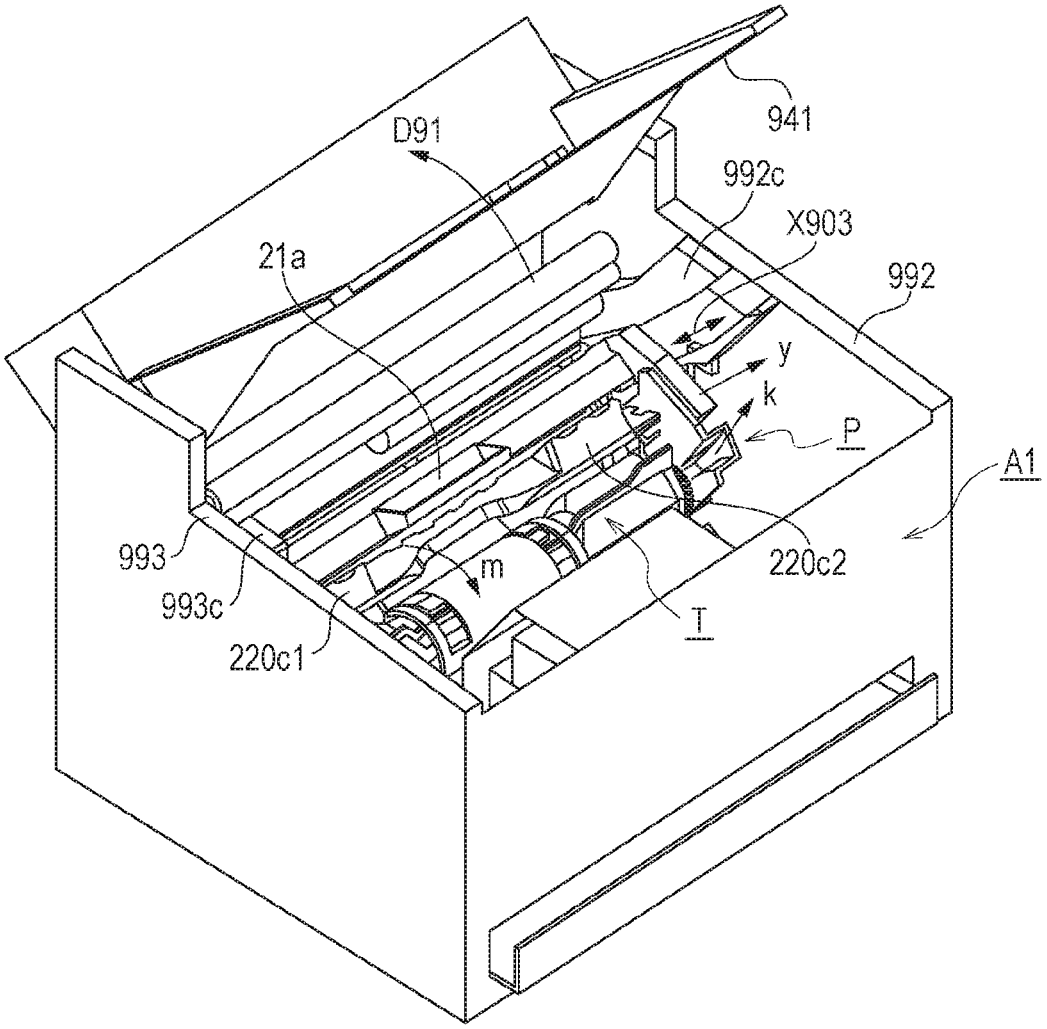
FIG. 20 is a perspective view illustrating attachment and detachment of the process cartridge and the toner cartridge according to the embodiment of the disclosure.

The positioning portion 930*b* of the driving-side drum bearing 930 is set to receive an urging force from a driving side pressing member 982 as illustrated in FIG. 19, so that the positioning portion 930*b* contacts a positioning portion 992*f* provided in the driving side guide member 992. On the non-driving side as well, the non-driving side of the process cartridge P is positioned and fixed with respect to the non-driving side guide member 993, with a similar configuration to that of the driving side. As a result, the driving side drum bearing 930 of the process cartridge P is positioned and fixed with respect to the driving side guide member 992 and the non-driving side drum bearing 931 thereof is positioned and fixed with respect to the non-driving side guide member 993.

Detachment of Process Cartridge P from Image Forming Apparatus Main Body A1

A method of detaching the process cartridge P from the image forming apparatus main body A1 will be described. As illustrated in FIG. 20, the opening and closing member 941 that is arranged at the top part of the image forming apparatus main body A1 and is openable and closable is rotated in the direction of the arrow D91 in which the opening and closing member 941 is opened. Thereby, the process cartridge P and the toner cartridge T are exposed.

The user grips the first grip 21*a* of the process cartridge P and pulls out the process cartridge P in a direction of an arrow y against the urging force that the positioning portion 930*b* of the driving side drum bearing 930 receives from the driving side pressing member 982 (FIG. 19). Thereby, the process cartridge P leaves the decided position along the attaching/detaching path X903 formed by the guide portion 992*c* of the driving side guide member 992 and the guide portion 993*c* of the non-driving side guide member 993. The process cartridge P is further pulled out by the user to be pulled out to the outside of the image forming apparatus main body A1, and thereby the detachment of the process cartridge P is completed.

(10) Configuration of Attachment or Detachment of toner Cartridge T to or from Image Forming Apparatus Main Body A1

Figure 21A:
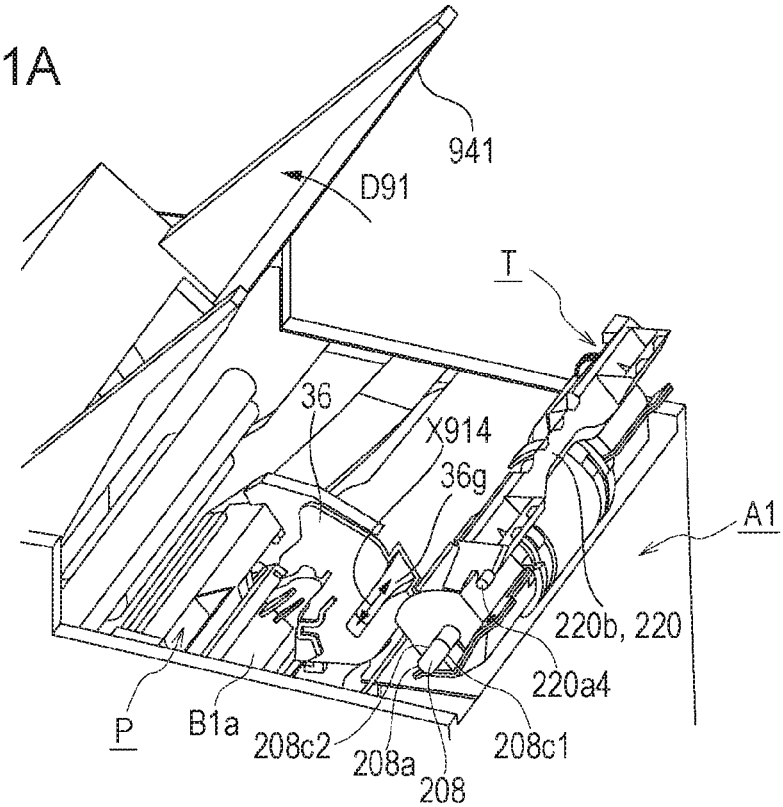
FIGS. 21A and 21B are perspective views illustrating a process where the toner cartridge is attached to the process cartridge according to the embodiment of the disclosure.
Figure 21B:
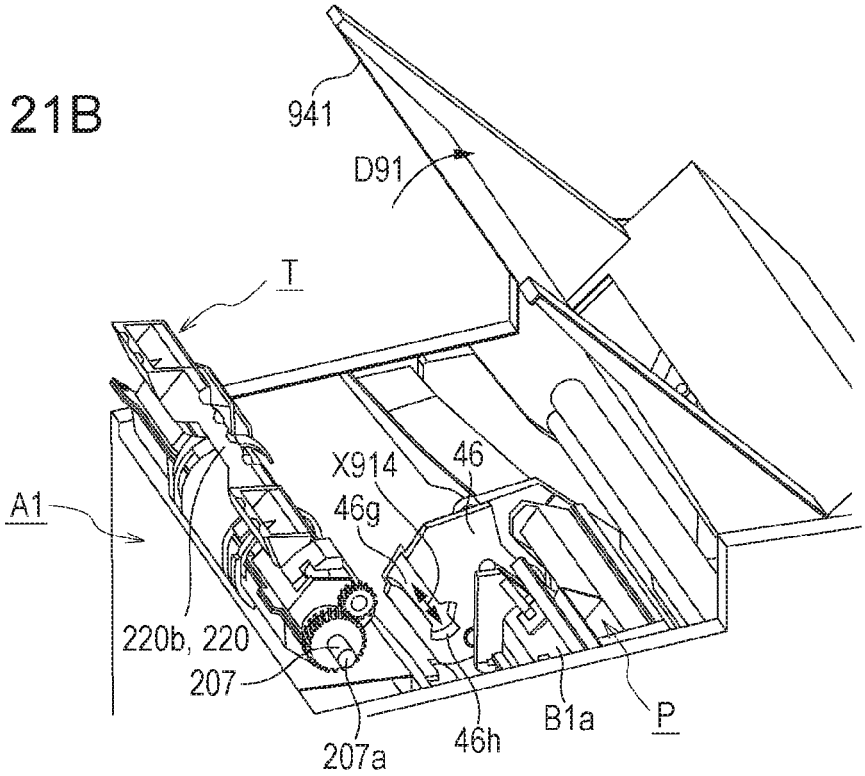

Next, a method of attaching or detaching the toner cartridge T to or from the image forming apparatus main body A1 will be described with reference to FIGS. 1A, 1B, 14A, 15A, 20, 21A, and 21B. FIG. 21A is an explanatory perspective view of the image forming apparatus main body A1 to which the process cartridge P is attached as seen from the non-driving side and FIG. 21B is an explanatory perspective view of the image forming apparatus main body A1 to which the process cartridge P is attached as seen from the driving side.

As illustrated in FIG. 21A, the insertion guided portion 208 is provided on the non-driving side of the toner cartridge T. As described above, the insertion guided portion 208 has the regulation portions 208*c*1 and 208*c*2. Moreover, the insertion guided portion 207 is provided on the driving side of the toner cartridge T as illustrated in FIG. 21B. As described above, the insertion guided portion 207 has the abutting portion 207*a*.

On the other hand, as illustrated in FIG. 21A, the driving side development bearing 36 is provided on the driving side of the process cartridge P. The driving side development bearing 36 is provided with the insertion guide 36*g*. Moreover, the non-driving side development bearing 46 is provided on the non-driving side of the process cartridge P as illustrated in FIG. 21B. As described above, the non-driving side development bearing 46 is provided with the insertion guide 46*g*. A groove shape that extends along an attaching/detaching path X914 of the toner cartridge T is formed in the insertion guide 36*g* of the driving side development bearing 36 and the insertion guide 46*g* of the non-driving side development bearing 46.

Attachment of Toner Cartridge T to Image Forming Apparatus Main Body A1

A method of attaching the toner cartridge T to the image forming apparatus main body A1 will be described. As illustrated in FIGS. 21A and 21B, the opening and closing member 941 that is arranged at the top part of the image forming apparatus main body A1 and is openable and closable is rotated in the direction of the arrow D91 in which the opening and closing member 941 is opened. Thereby, the inside of the image forming apparatus main body A1 is exposed.

While keeping the first portion 220*b* of the second grip 220 of the toner cartridge T, the user then causes the insertion guided portion 208 of the toner cartridge T to be engaged with the insertion guide 46*g* of the non-driving side development bearing 46 of the process cartridge P. The user-also causes the insertion guided portion 207 of the toner cartridge T to be engaged with the insertion guide 36*g* of the driving side development bearing 36 of the process cartridge P. Then, the toner cartridge T is inserted in the toner cartridge storage portion B1*a* of the process cartridge P inside the image forming apparatus main body A1 along the attaching/detaching path X914 formed by the insertion guide 46*g* of the non-driving side development bearing 46 and the insertion guide 36*g* of the driving side development bearing 36.

The toner cartridge T is inserted until the abutting portion 208*a* of the toner cartridge T abuts to the abutted portion 46*h* of the non-driving side development bearing 46. Thereby, the insertion of the toner cartridge T into the toner cartridge storage portion B1*a* of the process cartridge P inside the image forming apparatus main body A1 is completed (FIG. 14A). Note that, at a time when the insertion of the toner cartridge T into the toner cartridge storage portion B1*a* is completed, the toner cartridge T is at a position where the first portion 220*b* of the second grip 220 is exposed from the first grip 21*a* of the process cartridge P as seen from a rotational axial direction of the photosensitive drum 10 (FIG. 1A).

The toner frame 40 of the toner cartridge T inserted in the process cartridge P inside the image forming apparatus main body A1 is rotated in a counterclockwise manner in a direction of an arrow e in FIG. 1A) illustrated in FIG. 1A. Then, as described above, the opening and closing guided portion 208*b* of the toner cartridge T is engaged with the opening and closing guide portion 46*k* and a position of the toner cartridge T is decided relative to the process cartridge P in the image forming apparatus main body A1 (refer to FIG. 15A). The toner cartridge T positioned with respect to the process cartridge P in the image forming apparatus main body A1 is further rotated in the direction of the arrow e. As a result, the opening of the supply opening portion 200 of the toner cartridge T and the receiving opening portion 16*d* of the process cartridge P is completed and the attachment of the toner cartridge T is completed.

When the attachment of the toner cartridge T is completed, the first portion 220*b* of the second grip 220 is stored in the toner cartridge storage portion B1*a* between the first grip 21*a* and the developer containing portion 16*a* (FIG. 1B). Since a position of the first portion 220*b* corresponds to a longitudinal position opposed to the first grip 21*a*, at least a part of the first portion 220*b* is shielded by the first grip 21*a* as seen from a direction of the attaching/detaching path X914 of the toner cartridge T. On the other hand, since the second portion 220*c*1 and the second portion 220*c*2 are arranged at longitudinal positions where the second portion 220*c*1 and the second portion 220*c*2 do not overlap with the first grip 21*a*, the second portion 220*c*1 and the second portion 220*c*2 are exposed from the first grip 21*a* as seen from the direction of the attaching/detaching path X914 of the toner cartridge T (FIG. 1C).

Detachment of Toner Cartridge T from Image Forming Apparatus Main Body A1

A method of detaching the toner cartridge T from the image forming apparatus main body A1 will be described. As illustrated in FIG. 20, the opening and closing member 941 that is arranged at the top part of the image forming apparatus main body A1 and is openable and closable is rotated in the direction of the arrow D91 in which the opening and closing member 941 is opened. Thereby, the process cartridge P and the toner cartridge T are exposed.

The user grips at least one of the second portion 220*c*1 and the second portion 220*c*2 of the toner cartridge T to rotate the toner cartridge T in a direction of an arrow m illustrated in FIG. 1B. Thereby, the supply opening portion 200 of the toner cartridge T and the receiving opening portion 16*d* of the process cartridge P are closed. When the toner cartridge T is rotated until an insertion completion state into the process cartridge P (FIG. 1A) is brought, the supply opening portion 20 of the toner cartridge T and the receiving opening portion 16*d* of the process cartridge P are completely closed. Further, the toner cartridge T is pulled out in a direction of an arrow k illustrated in FIG. 20. Thereby, the toner cartridge T is separated from the toner cartridge storage potion B1*a* of the process cartridge P along the attaching/detaching path X914 formed by the insertion guide 36*g* of the driving side development bearing 36 and the insertion guide 46*g* of the non-driving side development bearing 46 (FIGS. 21A and 21B). The toner cartridge T is further pulled out by the user to be pulled out to the outside of the image forming apparatus main body A1, and thereby the detachment of the toner cartridge T is completed.

(11) Toner Cartridge Incomplete Attachment Detection Unit

Configuration of Toner Cartridge Incomplete Attachment Detection Unit

Figure 22A:
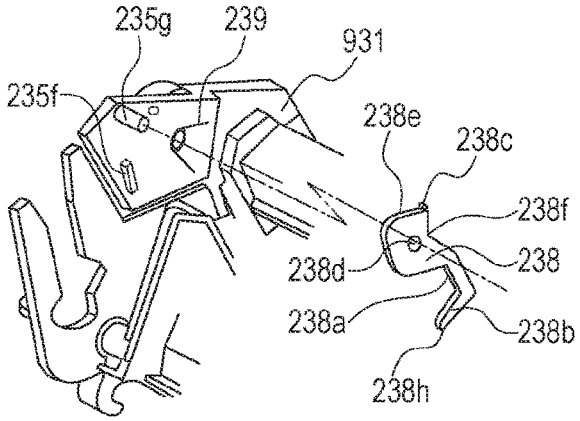
FIGS. 22A to 22C are views for explaining a rotation member provided in the process cartridge according to the embodiment of the disclosure.
Figure 22B:
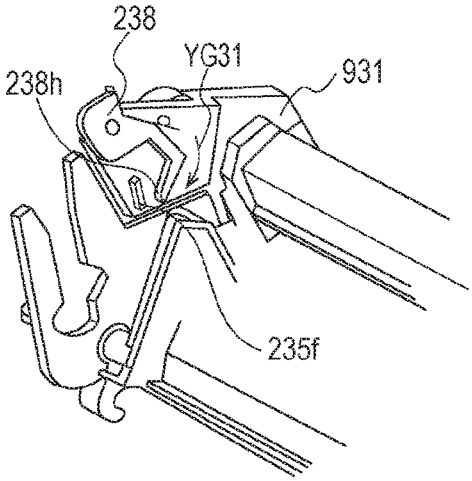
Figure 22C:
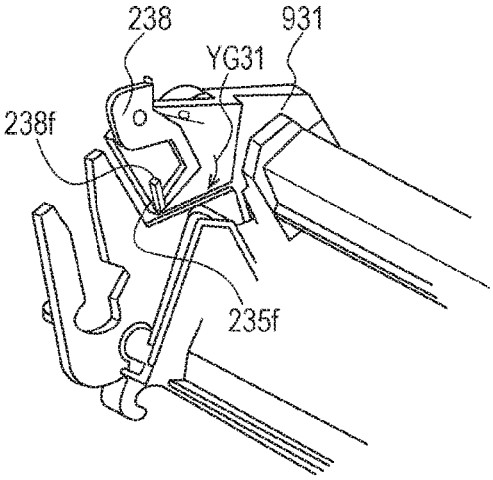
Figure 23:
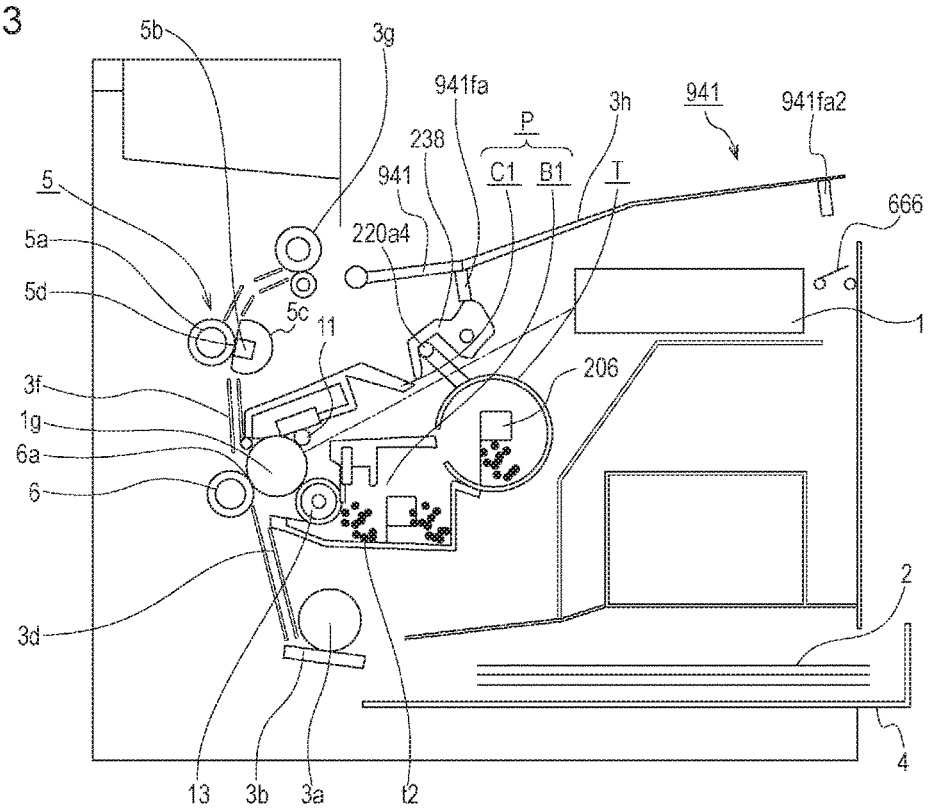
FIG. 23 is a cross-sectional view illustrating the image forming apparatus in which closing of an opening and closing member is prevented by the rotation member according to the embodiment of the disclosure.

With reference to FIGS. 2, 22A to 22C, and 23, an incomplete attachment detection unit of the toner cartridge T in a state (attachment completion state) where the opening and closing member 941 is completely closed and the toner cartridge T is attached will be described. FIGS. 22A to 22C are views for explaining a configuration of a rotation member 238. FIG. 23 illustrates a state where the incomplete attachment detection unit of the toner cartridge T prevents the opening and closing member 941 from closing the opening.

As illustrated in FIG. 2, the opening and closing member 941 is provided with a projection portion 941*fa* (protrusion portion) that protrudes toward a cartridge attachment space that is closed when the opening and closing member 941 is closed and an engagement portion 941*fa*2. The engagement portion 941*fa*2 acts on a switch 666 provided in the image forming apparatus main body A1 and allows detecting an opening or closing state of the opening and closing member 941, that is, whether or not an opening portion provided in the image forming apparatus main body A1 is completely closed by the opening and closing member 941. That is, a configuration is such that the opening or closing state of the opening and closing member 941 is detected by the engagement portion 941*fa*2 of the opening and closing member 941 and an opening and closing detection portion of the opening and closing member 941, which is constituted by the switch 666 of the image forming apparatus main body A1, so that image formation is not executed with the opening and closing member 941 opened.

On the other hand, as illustrated in FIGS. 22A to 22C, in the drum unit C1 of the process cartridge P, an abutting portion 235*f* and a shaft 235*g* are formed in the driving side drum bearing 931. The shaft 235*g* is inserted in a center portion 238*d* that is a through hole provided in the rotation member 238 and the rotation member 238 is supported rotatably with the center portion 238*d* as a rotation center. Note that, a torsion spring 239 is attached to the rotation member 238 between the rotation member 233 and the driving side drum bearing 931. A configuration is such that the rotation member 238 is rotatable urged in a direction of an arrow YG31 by the torsion spring 239 and a leading end portion 238*h* of the rotation member 238 is enabled to contact the abutting portion 235*f* provided in the driving side drum bearing 931.

The rotation member 238 includes, in addition to the center portion 238*d* and the abutting portion 235*f*, a first contact portion 238*a*, a second contact portion 238*b* (acted portion) which is connected to the first contact portion 238*a*, a contact portion 238*e*, and a retracting portion 238*f* that is connected to the contact portion 238*e* via a corner portion 238*c*. The contact portion 238*e* has a concentric circular arc shape centered about the rotation center of the rotation member 238. The retracting portion 238*f* is a part whose distance from the center portion 238*d* of the rotation member 238 (rotation center of the rotation member 238) in a radial direction is minimum and is not limited to a concave portion as in the present embodiment.

When the toner cartridge T is at an attachment completion position, the rotation member 238 rotates against an urging force of the torsion spring 239 and the projection portion 941*fa* of the opening and closing member 941 is in a state of being engaged with the retracting portion 238*f* of the rotation member 238. In this manner, a configuration is such that the rotation member 238 rotates to retract from a position of the projection portion 941*fa* when the opening and closing member 941 is completely closed and does not interfere. As a result, the configuration is such that the closing of the opening and closing member 941 is allowed when the toner cartridge T is at the attachment completion position.

That is, the configuration is such that, when the toner cartridge T is at the attachment completion position, the projection portion 941*fa* is engaged with the retracting portion 238*f* to allow the closing of the opening and closing member 941, whereas the engagement portion 941*fa*2 acts on the switch 666, so that the opening or closing state of the opening and closing member 941 is able to be detected. In this manner, whether or not the toner cartridge T is completely attached is able to be detected in accordance with an opening or closing state of the opening and closing member 941, and image formation is not executed when the toner cartridge T is not attached or is incompletely attached. In other words, by using the opening and closing detection portion of the opening and closing member 941, it is set that image formation is not executed when the toner cartridge T is not attached or is incompletely attached.

When the user fails to attach the toner cartridge T or does not attach the toner cartridge T to the attachment completion position. so that the toner cartridge T is in a state of being incompletely attached in partway of attachment, the toner t2 is not supplied from the toner cartridge T to the development unit B1. Thus, in a case where an image forming operation is continued, printing is not able to be performed on the recording medium 2, and also the development roller 13 and the elastic member 15*b* slide without using sufficient toner t2, and further, the development roller 13 contacts the photosensitive drum 10 in a state where sufficient toner is not fed on the development roller 13. The toner t2 also functions as lubricant between the development roller 13 and the development blade 15 and between the development roller 13 and the photosensitive member 10. When the image forming operation is continued in a state where the toner t2 is exhausted and there is no lubricant, sliding friction becomes large between the development roller 13 and the development blade 15 and between the development roller 13 and the photosensitive drum 10 and rotation torque of the development roller 1 and the photosensitive drum 10 also increases. When such a state is continued for a long time, the development roller 13, the development blade 15, and the photosensitive drum 10 are abraded, and even when the toner cartridge T is correctly attached again and the toner t2 is supplied, image defect may be caused. However, the present configuration such that image formation is not executed when the toner cartridge T is not attached or is incompletely attached. As a result, it is possible to prevent occurrence of image defect that is caused when the toner t2 is exhausted and the development roller 13, the development blade 15, and the photosensitive drum 10 are abraded.

Toner Cartridge Attaching Process and Toner Cartridge Incomplete Attachment Detection Unit A state of the toner cartridge incomplete attachment detection unit in an attaching process of the toner cartridge T will be described below.

(i) When toner Cartridge T is not Attached

When the toner cartridge T is not attached in the image forming apparatus main body A1, the process cartridge P in the state of FIG. 22C is attached. In the process cartridge P, the rotation member 238 is urged by the torsion spring 239 (not illustrated) to be positioned at a first position where the leading end portion 238*h* of the rotation member 238 contacts the abutting portion 235*f* provided in the driving side drum bearing 931. In a case where the rotation member 238 is at the first position, the projection portion 941*fa* of the opening and closing member 941 contacts the contact portion 238*e* of the rotation member 233 when the opening and closing member 941 is to be closed. By the projection portion 941*fa* contacting the contact portion 238*e*, the opening and closing member 941 is prevented from completely closing the opening of the image forming apparatus main body A1. Thereby, the projection portion 941*fa* of the opening and closing member 941 does not act on the switch 666 of the image forming apparatus main body A1 and the opening state of the opening and closing member 941 is able to be detected. In this manner, the configuration is such that when the opening is incompletely closed, the user is able to be notified that the toner cartridge T is not attached, and image formation is not executed while the opening and closing member 941 is opened.

(ii) When Toner Cartridge T is Only Inserted in Process Cartridge P

In a case where the toner cartridge T is inserted in the process cartridge P attached to the image forming apparatus main body A1, the rotation member 238 is at the first position similarly to the case where the toner cartridge T is not attached. Thus, when the toner cartridge T is only inserted in the process cartridge P, the projection portion 941*fa* contacting the contact portion 238*e* prevents the opening and closing member 941 from completely closing the opening of the image forming apparatus main body A1. Thereby, the projection portion 941*fa* of the opening and closing member 941 does not act on the switch 666 of the image forming apparatus main body A1 and the opening state of the opening and closing member 941 is able to be detected. In this manner, the configuration is such that when the opening is incompletely closed, the user is able to be notified that the toner cartridge T is not attached, and image formation is not executed while the opening and closing member 941 is opened.

(iii) When Toner Cartridge T is Stopped before Being Rotated to Attachment Completion Position When the toner cartridge T inserted in the process cartridge P is rotated to the attachment completion position in a counterclockwise manner, the attachment is completed. A state of the incomplete attachment detection unit of the toner cartridge T when the toner cartridge T does not rotate to reach the attachment completion position and is stopped in partway will be described below.

In response to rotation of the toner cartridge T, a protrusion portion 220*a*4 (acting portion) of the toner cartridge T contacts the first contact portion 238*a* and the second contact portion 238*b* (acted portion), so that the rotation member 238 is rotated in a direction opposite to the toner cartridge T. Specifically, the toner cartridge T is rotated in a counterclockwise manner, so that the protrusion portion 220*a*4 (acting portion) of the toner cartridge T contacts the first contact portion 238*a* of the rotation member 238 and further slides and the rotation member 238 is rotated in a clockwise manner. In the configuration according to the present embodiment, as the toner cartridge T is rotated, the protrusion portion 220*a*4 contacts the first contact portion 238*a* and slides, and then, the protrusion portion 220*a*4 contacts the second contact portion 238*b*. The first contact portion 238*a* and the second contact portion 238*b* are configured so that surfaces of the first contact portion 238*a* and the second contact portion 238*b*, which contact the protrusion portion 220*a*4, intersect with each other. As a result, even when the rotation member 238 is rotated at the same speed as that of the toner cartridge T, the rotation speed of the rotation member 238 is able to be differentiated depending on whether the protrusion portion 220*a*4 contacts the first contact portion 238*a* or the second contact portion 238*b*. In the present embodiment, the rotation member 238 is able to be rotated at a higher speed when the protrusion portion 220*a*4 contacts the second contact portion 238*b* compared to the case where the protrusion portion 220*a*4 contacts the first contact portion 238*a*.

A configuration is such that when the toner cartridge T stays at a position in partway of the insertion, the contact portion 238*e* of the rotation member 238 is positioned in a region into which the projection portion 941*fa* of the opening and closing member 941 enters when the opening and closing member 941 is closed. With such a configuration, when the opening and closing member 941 is to be closed as illustrated in FIG. 23, the projection portion 941*fa* interferes with the contact portion 238*e* and the opening and closing member 941 is prevented from being completely closed. Thereby, the projection portion 941*fa* of the opening and closing member 941 does not act on the switch 666 of the image forming apparatus main body A1 and the opening state of the opening and closing member 941 is able to be detected. In this manner, the configuration is such that when the opening is incompletely closed, the user is able to be notified that the toner cartridge T is not attached, and image formation is not executed while the opening and closing member 941 is opened.

(iv) When Toner Cartridge T is Rotated to Attachment Completion Position configuration is such that the corner portion 238*c* provided between the contact portion 238*e* and the retracting portion 238*f* passes through the region into which the projection portion 941*fa* of the opening and closing member 941 enters when the opening and closing member 941 is closed, and the projection portion 941*fa* is stored in the retracting portion 238*f* so as not to contact the contact portion 238*e* (FIG. 2). Specifically, the configuration is such that, in addition to lengths and arrangement of the first contact portion 238*a* and the second contact portion 238*b* of the rotation member 238, a length, arrangement, and the like of the contact portion 238*e* are adjusted as appropriate, so that the projection portion 941*fa* is stored in the retracting portion 238*f* when the toner cartridge T is at the attachment completion position. Thereby, the configuration is such that when the opening and closing member 941 is to be closed, the projection portion 941*fa* does not interfere with the contact portion 238*e* and is stored in the retracting portion 238*f*, so that the opening and closing member 941 is allowed to be completely closed. On the other hand, the projection portion 941*fa* of the opening and closing member 941 acts on the switch 666 of the image forming apparatus main body A1 and the closing state of the opening and closing member 941 is detected, so that the state is able to be switched to a state where image formation is able to be executed.

Note that, in the attachment completion state, the second drive transmitting portion 211 of the toner cartridge T meshes with the first drive transmitting portion 38 of the process cartridge P and the development shutter 301 of the development unit B1 and the toner shutter 201 of the toner cartridge T are opened. As a result, when the attachment of the toner cartridge T is completed, a driving force is able to be transmitted from the image forming apparatus main body A1 to the toner cartridge T and the toner t2 of the toner cartridge T is able to be supplied to the process cartridge P. Thus, the rotation member 238 is configured so that when the development shutter 301 and the toner shutter 201 are opened and a state where the second drive transmitting portion 211 surely meshes with the first drive transmitting portion 38 is brought, it is considered that the attachment is completed and the opening and closing member 941 becomes able to be completely closed. Specifically, at timing at least when the second drive transmitting portion 211 of the toner cartridge T meshes with the first drive transmitting portion 38 of the process cartridge P, in other words, after the toner cartridge T reaches a given rotation angle, the opening and closing member 941 is able to be completely closed.

That is, before timing when the corner portion 238*c* passes through the region into which the projection portion 941*fa* enters in a process where the toner cartridge T is rotated, the second drive transmitting portion 211 surely meshes with the first drive transmitting portion 38.

Note that, description has been given in the aforementioned embodiment with an example that the toner cartridge T is detachably attachable to the process cartridge P including the photosensitive drum 10. However, there is no limitation thereto and the same is also applied to a configuration in which the toner cartridge T is detachably attachable to a development cartridge B. A component corresponding to the development unit B1 and a component corresponding to the drum unit C1 the components of the process cartridge P in the aforementioned embodiment are respectively set as the development cartridge B and a drum cartridge C. The process cartridge P, the development cartridge B, and the drum cartridge C are different from those of the aforementioned embodiment in terms of being individually detachably attachable to the image forming apparatus main body A1 but have a similar configuration, so that description thereof will be omitted. Functions, materials, shapes, relative positions, or the like of the components described in the aforementioned embodiment do not limit the scope of the disclosure only thereto unless otherwise specified, and may be changed as appropriate within the scope of the disclosure.

Meanwhile, a configuration in which usability is further improved is demanded for attachment/detachment performance of a process cartridge and a toner cartridge.

As described above, in the present embodiment, the configuration is such that a part of the second grip 220 of the toner cartridge T is covered by the first grip 21*a* of the process cartridge P while the toner cartridge T is attached to the process cartridge P. That is, by arranging the first grip 21*a* so as to cover at least a part of the second grip 220 as seen from the opening of the image forming apparatus main body A1, the second grip 220 is intendedly arranged at an inconspicuous position where the second grip 220 is difficult to be gripped. Thereby, it is possible to suppress erroneously detaching the toner cartridge T that may cause toner scattering or the like from the process cartridge P without intention, thus making it possible to improve usability. In addition, for example, even when a recording medium is jammed in a conveyance path in the image forming apparatus main body A1 and jam recovery is performed, the process cartridge P is able to be detached. from the image forming apparatus main body A1 stably with the toner cartridge T attached to the process cartridge P. Particularly in the present embodiment, a pull-out direction (direction y) in which the process cartridge P is pulled out from the image forming apparatus main body A1 is set as to be the same or substantially the same as a pull-out direction (direction) in which the toner cartridge T is pulled out from the process cartridge P. Further, it is set that the process cartridge P and the toner cartridge T are able to be detached from the same opening portion. In such a case as well, the process cartridge P is able to be detached more stably. On the other hand, by gripping at least one of the second portion 220*c*1 and the second portion 220*c*2 and rotating the toner cartridge T with respect to the process cartridge P, the second grip 220 of the toner cartridge T is able to be exposed from the process cartridge P. Then, by pulling out the second grip 220 to the outside of the image forming apparatus main body A1, only the toner cartridge T is able to be detached easily with the process cartridge P attached to the image forming apparatus main body A1.

Note that, description has been given in the aforementioned embodiment with an example that the toner cartridge T is detachably attachable to the process cartridge P including the photosensitive drum 10. However, there is no limitation thereto and the same is also applied to a configuration in which the toner cartridge T is detachably attachable to a development cartridge B2. A component corresponding to the development unit B1 and a component corresponding to the drum unit C1 in the components of the process cartridge P in the aforementioned embodiment are respectively set as the development cartridge B2 and a drum cartridge C. The process cartridge P, the development cartridge B, and the drum cartridge C are different from those of the aforementioned embodiment in terms of being individually detachably attachable to the image forming apparatus main body A1 but have a similar configuration, so that description thereof will be omitted. Functions, materials, shapes, relative positions, or the like of the components described in the aforementioned embodiment do not limit the scope of the disclosure only thereto unless otherwise specified, and may be changed as appropriate within the scope of the disclosure.

An image forming apparatus according to the aforementioned embodiment includes a development cartridge that has, in addition to a developer carrier that carries developer on a surface thereof to convey the developer, a development, blade that regulates the developer carried on the surface of the developer carrier, a toner cartridge that is attached to the development cartridge and supplies the developer to the development cartridge, and an opening and closing member that closes an opening through which the development cartridge and the toner cartridge are inserted, in which the development cartridge and the toner cartridge are individually detachably attachable, and in which the development cartridge includes a development frame which supports the developer carrier and the development blade and is provided with a first grip portion that is able to be gripped when a user inserts the development cartridge in an image forming apparatus main body, the toner cartridge includes a toner frame which contains the developer and is provided with a second grip portion that is able to be gripped when the user inserts the toner cartridge in the development cartridge, and the first grip portion is arranged so as to cover at least a part of the second grip portion as seen from the opening when the toner cartridge is attached to the development cartridge in a state where the development cartridge is attached to the image forming apparatus main body.

Another image forming apparatus according to the aforementioned embodiment includes a process cartridge that has, in addition to an image carrier, a developer carrier that develops an electrostatic latent image formed on a surface of the image carrier, and a development blade that regulates the developer carried on the surface of the developer carrier, a toner cartridge that is attached to the process cartridge and supplies the developer to the process cartridge, and an opening and closing member that closes an opening through which the process cartridge and the toner cartridge are inserted, in which the process cartridge and the toner cartridge are individually detachably attachable, and in which the process cartridge includes a frame which supports, in addition to the image carrier, the developer carrier and the development blade and is provided with a first grip portion that is able to be gripped when a user inserts the process cartridge in an image forming apparatus main body, the toner cartridge includes a toner frame which contains the developer and is provided with a second grip portion that is able to be gripped when the user inserts the toner cartridge in the process cartridge, and the first grip portion is arranged so as to cover at least a part of the second grip portion as seen from the opening when the toner cartridge is attached to the process cartridge in a state where the process cartridge is attached to the image forming apparatus main body.

A cartridge according to the present embodiment is a development cartridge that is detachably attachable to an image forming apparatus, which has, in addition to an opening, an opening and closing member that closes the opening, through the opening separately from a toner cartridge having developer contained in a toner frame, and the development cartridge attached to the image forming apparatus with the toner cartridge attached includes a developer carrier that carries developer on a surface thereof to convey the developer, a development blade that regulates the developer carried on the surface of the developer carrier, and a development frame which supports the developer carrier and the development blade and is provided with a first grip portion that is able to be gripped when a user inserts the development cartridge in an image forming apparatus main body, and the first grip portion is arranged so as to cover at least a part of the second grip portion, which is able to be gripped when a user inserts the toner cartridge in the development cartridge and which is provided in a toner frame, as seen from the opening when the toner cartridge is attached to the development cartridge in a state where the development cartridge is attached to the image forming apparatus main body.

A process cartridge according to the aforementioned embodiment is detachably attachable to an image forming apparatus, which has, in addition to an opening, an opening and closing member that closes the opening, through the opening separately from a toner cartridge having developer contained therein, and the process cartridge attached to the image forming apparatus with the toner cartridge attached includes an image carrier, a developer carrier that develops an electrostatic latent image formed on a surface of the image carrier, a development blade that regulates the developer carried on the surface of the developer carrier, and a frame which supports, in addition to the image carrier, the developer carrier and the development blade and is provided with a first grip portion that is able to be gripped when a user inserts the process cartridge in an image forming apparatus main body, and the first grip portion is arranged so as to cover at least a part of the second grip portion, which is able to be gripped when a user insets the toner cartridge in the process cartridge and which is provided in a toner frame, as seen from the opening when the toner cartridge is attached to the process cartridge in a state where the process cartridge is attached to the image forming apparatus main body.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-142023 filed Jul. 21, 2017 and No. 2017-142024 filed Jul. 21, 2017, which are hereby incorporated by reference herein in their entirety.

What is claimed is:

1. An image forming apparatus comprising:

a cartridge that includes a developer carrier configured to carry developer on a surface thereof and a blade configured to regulate thickness of the developer carried on the surface of the developer carrier;

a developer container detachably attachable to the cartridge and containing the developer, wherein the developer container is movable, with respect to the cartridge, between a first position and a second position different from the first position in a state where the developer container is attached to the cartridge;

an apparatus main body that has an attachment portion to which the cartridge is attached, the apparatus main body including an opening through which the cartridge passes when the cartridge is attached to the attachment portion and an opening and closing member that is configured to be movable between an open position where the opening is opened and a close position where the opening is closed; and a moving member that moves so that in a case where the cartridge in which the developer container is attached at the first position is attached to the attachment portion, the moving member is at a position of preventing movement of the opening and closing member from the open position to the close position, and in a case where the cartridge in which the developer container is attached at the second position is attached to the attachment portion, the moving member is at a position of allowing movement of the opening and closing member from the open position to the close position.

2. The image forming apparatus according to claim 1, wherein the apparatus is configured so that toner supply is not able to be supplied from the developer container to the cartridge in a case where the developer container is at the first position and toner supply is able to be supplied from the developer container to the cartridge in a case where the developer container is at the second position.

3. The image forming apparatus according to claim 2, wherein the cartridge has a first opening through which supply of the developer is received from the developer container and a first shutter that is configured to allow opening or closing of the first opening, and the developer container has a second opening through which the developer is supplied to the cartridge and a second shutter that is configured to allow opening or closing of the second opening, and in a case where the developer container is at the first position, the first opening is closed by the first shutter and the second opening is closed by the second shutter, and in a case where the developer container is at the second position, the first opening is opened by the first shutter, the second opening is opened by the second shutter, and the first opening is at a position opposed to the second opening, so that the developer is able to be supplied from the developer container to the cartridge through the first opening and the second opening.

4. The image forming apparatus according to claim 1, wherein in a case where the cartridge to which the developer container is not attached is attached to the attachment portion, the moving member is at a position of preventing movement of the opening and closing member from the open position to the close position.

5. The image forming apparatus according to claim 1, wherein the moving member is provided in the cartridge.

6. The image forming apparatus according to claim 1, wherein the developer container has a cylindrical shape, and movement of the developer container from the first position to the second position is rotational movement about a central axis that extends in a generatrix direction of the developer container.

7. A cartridge which is attachable, through an opening, to an apparatus main body of an image forming apparatus that has the opening and an opening and closing member that is configured to be movable between an open position where the opening is opened and a close position where the opening is closed, and to which a developer container having developer contained therein is detachably attachable, the cartridge comprising:

a developer carrier that carries developer on a surface thereof;

a blade that regulates thickness of the developer;

an attachment portion to which the developer container is attached, the attachment portion being configured so that the developer container is movable between a first position and a second position different from the first position in a state where the developer container is attached to the attachment portion; and a moving member that is configured to be movable to be at different positions between a case where the developer container is attached at the first position of the cartridge and a case where the developer container is attached ab the second position of the cartridge, in a case where the cartridge in which the developer container is attached at the first position is attached to the attachment portion, the moving member being at a position of preventing movement of the opening and closing member from the open position to the close position, and in a case where the cartridge in which the developer container is attached at the second position is attached to the attachment portion, the moving member being at a position of allowing movement of the opening and closing member from the open position to the close position.

8. The cartridge according to claim 7, wherein in a case where the cartridge to which the developer container is not attached is attached to the attachment portion, the moving member is at a position of preventing movement of the opening and closing member from the open position to the close position.

* * * * *